US005772149A

United States Patent [19]

Butterworth

[11] Patent Number: 5,772,149

[45] Date of Patent: Jun. 30, 1998

[54] WINDING CONTROL FINGER SURFACE REWINDER

[75] Inventor: Tad T. Butterworth, Ashland, Wis.

[73] Assignee: C. G. Bretting Manufacturing Company, Inc., Ashland, Wis.

[21] Appl. No.: 715,671

[22] Filed: Sep. 18, 1996

[51] Int. Cl.[6] ..... B65H 18/20; B65H 19/30

[52] U.S. Cl. ..... 242/533.2; 242/542

[58] Field of Search ..... 242/533, 533.2, 242/541, 542, 542.3

[56] References Cited

U.S. PATENT DOCUMENTS

| | | | |
|---|---|---|---|
| Re. 35,304 | 7/1996 | Biagiotti . | |
| 3,123,315 | 3/1964 | Couzens . | |
| 3,179,348 | 4/1965 | Nystrand et al. . | |
| 3,389,592 | 6/1968 | Bournez et al. . | |
| 3,727,853 | 4/1973 | Kinoshita | 242/533.2 |
| 3,823,887 | 7/1974 | Gerstein . | |
| 3,853,279 | 12/1974 | Gerstein . | |
| 3,856,226 | 12/1974 | Dowd, Jr. . | |
| 4,055,313 | 10/1977 | Yamaguchi et al. . | |
| 4,123,011 | 10/1978 | Kajiwara et al. . | |
| 4,238,082 | 12/1980 | Lund . | |
| 4,265,409 | 5/1981 | Cox et al. . | |
| 4,280,669 | 7/1981 | Leanna et al. . | |
| 4,327,877 | 5/1982 | Perini | 242/533.2 |
| 4,422,588 | 12/1983 | Nowisch . | |
| 4,448,363 | 5/1984 | Mukenschnabl . | |
| 4,487,377 | 12/1984 | Perini . | |
| 4,487,378 | 12/1984 | Kobayashi . | |
| 4,508,283 | 4/1985 | Beisswanger . | |
| 4,529,141 | 7/1985 | McClenathan . | |
| 4,575,018 | 3/1986 | Ichikawa . | |
| 4,588,138 | 5/1986 | Spencer . | |
| 4,635,867 | 1/1987 | Kytönen . | |
| 4,695,005 | 9/1987 | Gietman, Jr. . | |
| 4,697,755 | 10/1987 | Kataoka . | |
| 4,721,266 | 1/1988 | Haapanen et al. . | |

(List continued on next page.)

FOREIGN PATENT DOCUMENTS

| | | | |
|---|---|---|---|
| 9201176 | 12/1992 | Brazil . | |
| 9201177 | 12/1992 | Brazil . | |
| 0 452 284 A2 | 4/1991 | European Pat. Off. . | |
| 0 580 561 A2 | 7/1993 | European Pat. Off. . | |
| 19 35 584 | 6/1978 | Germany | 242/533.2 |
| 1033778 | 2/1975 | Italy . | |
| 1213819 | 9/1987 | Italy . | |
| 1213820 | 9/1987 | Italy . | |
| 1258172 | 2/1992 | Italy . | |
| 1259660 | 7/1992 | Italy . | |
| 1 435 525 | 5/1976 | United Kingdom . | |
| 2 105 688 | 3/1983 | United Kingdom . | |
| 2 150 536 | 7/1985 | United Kingdom . | |
| WO 94/21545 | 9/1994 | WIPO | 242/542 |
| WO 94/29205 | 12/1994 | WIPO . | |
| WO 95/10472 | 4/1995 | WIPO . | |
| WO 95/34498 | 12/1995 | WIPO . | |
| WO 96/32350 | 10/1996 | WIPO . | |

OTHER PUBLICATIONS

"Sincro/Fabio Perini" sales brochure, circa 1994.

PCMC "Magnum" Rewinder, date unknown pamphlet.

*Primary Examiner*—John P. Darling

*Attorney, Agent, or Firm*—Reinhart, Boerner, Van Deuren, Norris & Rieselbach, s.c.

[57] ABSTRACT

An apparatus and method for rewinding large rolls of paper into smaller rolls, such as bathroom tissue rolls. The rewinder includes three rolls forming a winding cradle and winding control fingers operating adjacent to and in the winding cradle. Upper and lower winding rolls are spaced apart far enough to allow a core to be introduced between them by the winding control fingers. A rider roll moves relative to the winding rolls to control the diameter of the paper roll being wound. The lower winding roll is preferably equipped with two sets of winding control fingers which can orbit around the roll and introduce the core between the winding rolls, separate the web, guide the web around the core and remove the completed log from the winding cradle.

20 Claims, 27 Drawing Sheets

U.S. PATENT DOCUMENTS 4,723,724 2/1988 Bradley .
4,783,015 11/1988 Shimizu .
4,798,350 1/1989 Jorgensen et al. .
4,828,195 5/1989 Hertel et al. .
4,856,725 8/1989 Bradley .
4,875,632 10/1989 Kataoka .
4,892,119 1/1990 Hugo et al. .
4,909,452 3/1990 Hertel et al. .
4,919,351 4/1990 McNeil .
4,931,130 6/1990 Biagiotti .
4,932,599 6/1990 Doerfel .
4,962,897 10/1990 Bradley .
4,988,051 1/1991 Welschlau et al. .
5,031,850 7/1991 Biagiotti ..... 242/542
5,038,647 8/1991 Biagiotti .
5,040,738 8/1991 Biagiotti ..... 242/542
5,104,055 4/1992 Buxton .
5,137,225 8/1992 Biagiotti ..... 242/542
5,150,848 9/1992 Consani .
5,150,850 9/1992 Adams .
5,226,611 7/1993 Butterworth et al. .
5,248,106 9/1993 Biagiotti ..... 242/533.2
5,249,756 10/1993 Biagiotti .
5,267,703 12/1993 Biagiotti .
5,271,137 12/1993 Schultz .
5,285,977 2/1994 Biagiotti .
5,312,059 5/1994 Membrino .
5,335,871 8/1994 Fissmann et al. .
5,344,091 9/1994 Molison .
5,357,833 10/1994 Biagiotti .
5,368,252 11/1994 Biagiotti .
5,368,253 11/1994 Hartley, Jr. .
5,370,335 12/1994 Vigneau .
5,383,622 1/1995 Kohler .
5,387,284 2/1995 Moody .
5,402,960 4/1995 Oliver et al. .
5,407,509 4/1995 Ishizu et al. .
5,409,178 4/1995 Stauber .
5,453,070 9/1995 Moody .
5,467,936 11/1995 Moody .
5,492,287 2/1996 Raudaskoski et al. .
5,497,959 3/1996 Johnson et al. .
5,505,402 4/1996 Vigneau .
5,505,405 4/1996 Vigneau .
5,509,336 4/1996 Biagiotti .
5,513,478 5/1996 Abt .
5,518,200 5/1996 Kaji et al. .
5,518,490 5/1996 Ziegelhoffer .
5,522,292 6/1996 Biagiotti .
5,524,677 6/1996 Summey, III .
5,538,199 7/1996 Biagiotti .
5,542,622 8/1996 Biagiotti .
5,544,841 8/1996 Didier et al. .
5,577,684 11/1996 Dropczynski et al. ..... 242/533.2
5,603,467 2/1997 Perini et al. ..... 242/533.2
5,620,151 4/1997 Ueyama et al. .
5,632,456 5/1997 Krüger .
5,639,045 6/1997 Dörfel .
5,639,046 6/1997 Biagiotti .

WINDING CONTROL FINGER SURFACE REWINDER

BACKGROUND

This invention relates generally to the field of paper converting, and more particularly to carefully controlling rewinding of a web of material from a large diameter roll into "logs" at very high speeds. The logs preferably comprise relatively small diameter rolls of paper that are subsequently cut into numerous short axial segments, resulting ultimately in rolls of bathroom tissue, kitchen towels or the like.

The highly competitive paper consumer product market requires manufacturers' rewinding processes to be highly automated and highly efficient at extremely high rewinding speeds. While some prior art rewinders have satisfactorily rewound high density products at average speeds, virtually every prior art device has difficulty rewinding low density product at average or high speeds. In most prior art rewinders, the low density products become unstable at higher speeds, decreasing product quality and sometimes ejecting the product from the rewinder.

Another difficulty with past continuous running surface rewinders has been the lack of efficient high speed separation of the web and the transfer of the lead edge of the separated web to the next core or mandrel at the completion of each log. Many systems for separation and transfer have been employed, but none have positively separated the web and transferred the leading edge at desired speeds. Further, prior rewinders have typically not been able to precisely control sheet counts and product length on the rolls.

It is therefore an object of the invention to provide an improved rewinder method and apparatus.

It is a further object of the invention to provide a novel rewinder method and apparatus that positively separates a material web.

It is another object of the invention to provide an improved rewinder method and apparatus that transfers a leading edge of a separated web to a core, mandrel or log formation process in a well controlled manner at high speed.

It is a still further object of the invention to provide a novel rewinder method and apparatus that increases rewinding speed while maintaining or improving product quality compared to prior art devices.

It is yet another object of the invention to provide an improved rewinder method and apparatus that increases rewinding speed while maintaining or improving coreless and cored product quality.

It is a further object of the invention to provide an improved rewinder method and apparatus that positively interacts with cores, mandrels or other winding initiation devices to prevent misfeeding and misalignment.

It is another object of the invention to provide an improved rewinder method and apparatus that reduces the complexity and increases production capacity of rewinding machines.

The present invention provides a more positive system of separation and transfer than typical prior art devices and requires fewer moving parts as well. Highly preferred embodiments of the present invention include winding control fingers which can be located adjacent the lower winding roll. Preferably, one or more winding control fingers insert a core or mandrel upon which material is wound, separate the material web and remove logs from a rewinding station.

Other advantages and features of the invention, together with the organization and manner of operation thereof, will become apparent from the following detailed description when taken in conjunction with the accompanying drawings, wherein like elements have like numerals throughout the drawings.

DETAILED DESCRIPTION OF PREFERRED EMBODIMENTS

Figure 1:
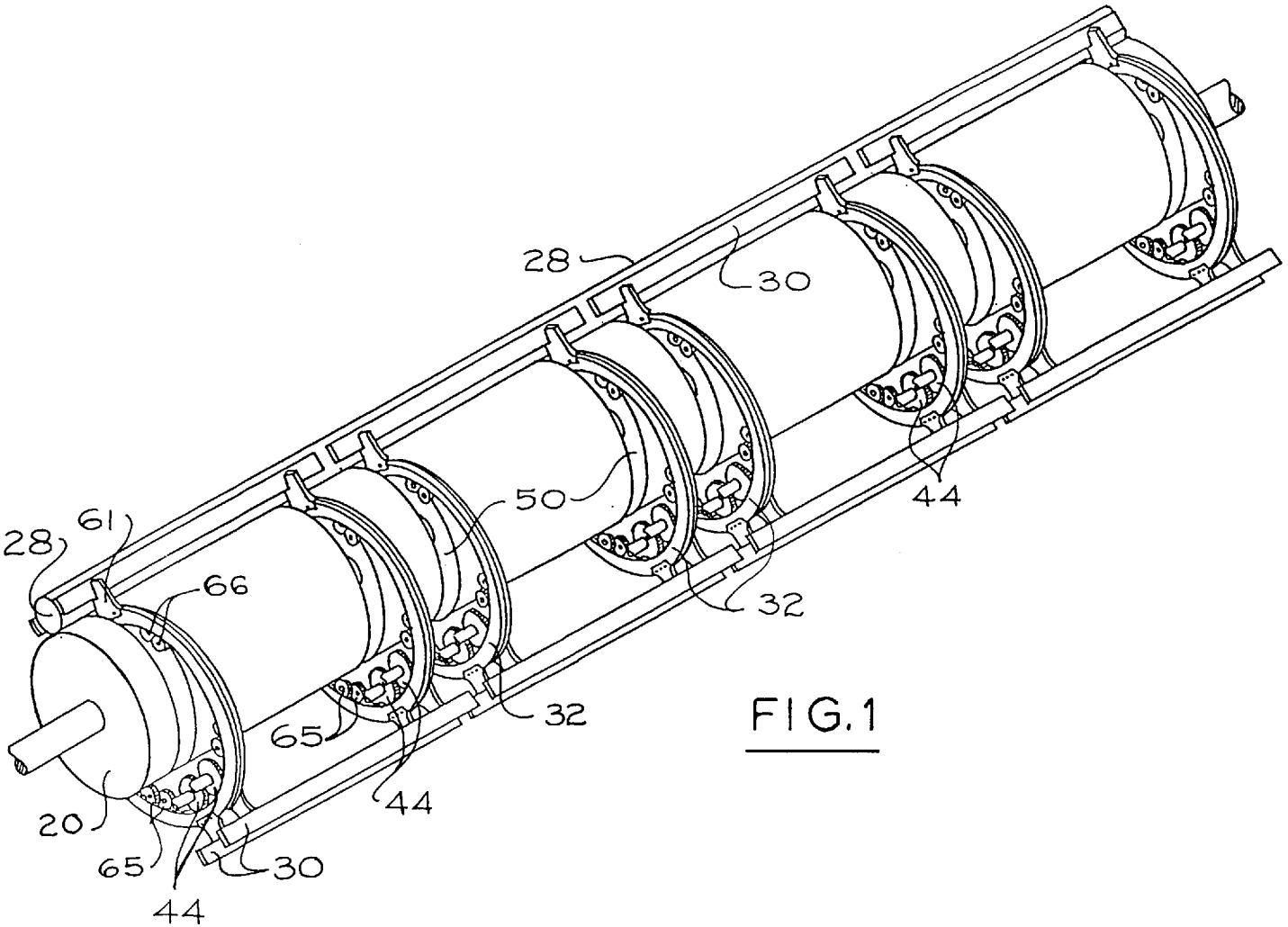
FIG. 1 shows a perspective view of a portion of a rewinder constructed in accordance with one preferred embodiment of the invention.

Referring to the Figures, and more particularly to FIG. 1, a rewinder constructed in accordance with one preferred embodiment of the invention is shown at 10. The rewinder 10 includes a number of stations at which various functions are performed. In one preferred embodiment, a web 12 of material is perforated transversely at a perforation station 14 and then is directed to an upper winding roll 16. While a variety of materials can be rewound satisfactorily using the present invention, a paper web 12 is described herein for illustrative purposes. The web 12 passes around the upper winding roll 16 and through a throat 18 between the upper winding roll 16 and a lower winding roll 20. Paper logs 22 are preferably wound in the cradle 24 between the upper winding roll 16, the lower winding roll 20 and a rider roll 26 as is known in the art, although the invention also offers advantages in other rewinding processes. The rider roll 26 is movable from a position close to the winding rolls 16, 20 when the log 22 is small to a position away from the winding rolls 16, 20 as the diameter of the log 22 increases. While roll structures are illustrated and described herein, belts and other mechanisms can also be used satisfactorily without departing from the invention.

Referring now to FIGS. 1–10, a plurality of winding control fingers 30 cooperate to control insertion of cores 28, separation of the web 12 and removal of the log 22 processes in the rewinder 10. While the embodiments illustrated in FIGS. 1–10 use cores 28, it will be apparent that the present invention is useful for winding coreless products using mandrels or other winding initiation devices as well.

A variety of independent and joined configurations of winding control fingers 30 can be used, although two sets 34 of two control fingers 30 are shown in accordance with one preferred embodiment of the invention. In this embodiment, the winding control fingers 30 run the length of the lower winding roll 20 with some short interruptions and orbit adjacent the lower winding roll 20. Alternatively, the winding control fingers 30 can orbit adjacent the upper winding roll 16 and contact the lower winding roll 16 or the rider roll 26. The winding control fingers 30 are supported by a series of rings 32 comprising steel or other durable material. Composite or plastic materials such as nylon and polymolybdenum sulfide material available from Midland Plastics located in Brookfield, Wis. can be used in the rings 32 to lessen drive loading and provide quicker control response. Each ring 32 can include an internal V-shaped track 38 and internal gear teeth 40 (shown in FIG. 4A), although a variety of mounting configurations for the rings 32 or other suitable support structures can be used. The track 38 supports each ring 32, preferably on a set of V-shaped wheels 42 as shown in FIGS. 4C–F. The internal gear teeth 40 mate with one or more drive gears 44 which drive the ring 32 in a conventional manner.

In another preferred embodiment, the rings 32 are divided into two sets 34, each set 34 having its own drive shaft 46 and each set 34 supporting two winding control fingers 30 mounted about 180 degrees apart on the rings 32. The rings 32 are preferably located in grooves 50 in the lower winding roll 20 in the cradle 24 where logs 22 are wound and emerge from the grooves 50 outside the cradle 24. Each of the two independent ring drive systems can drive the rings 32 in either direction and keep accurate position control throughout the winding process. A variety of conventional drives can be used, but preferably each set 34 is separately driven by its own servo motor 52. Alternatively, each winding control finger 30 can be separately driven by a servo motor 52 or other conventional drive mechanism.

Figure 5:
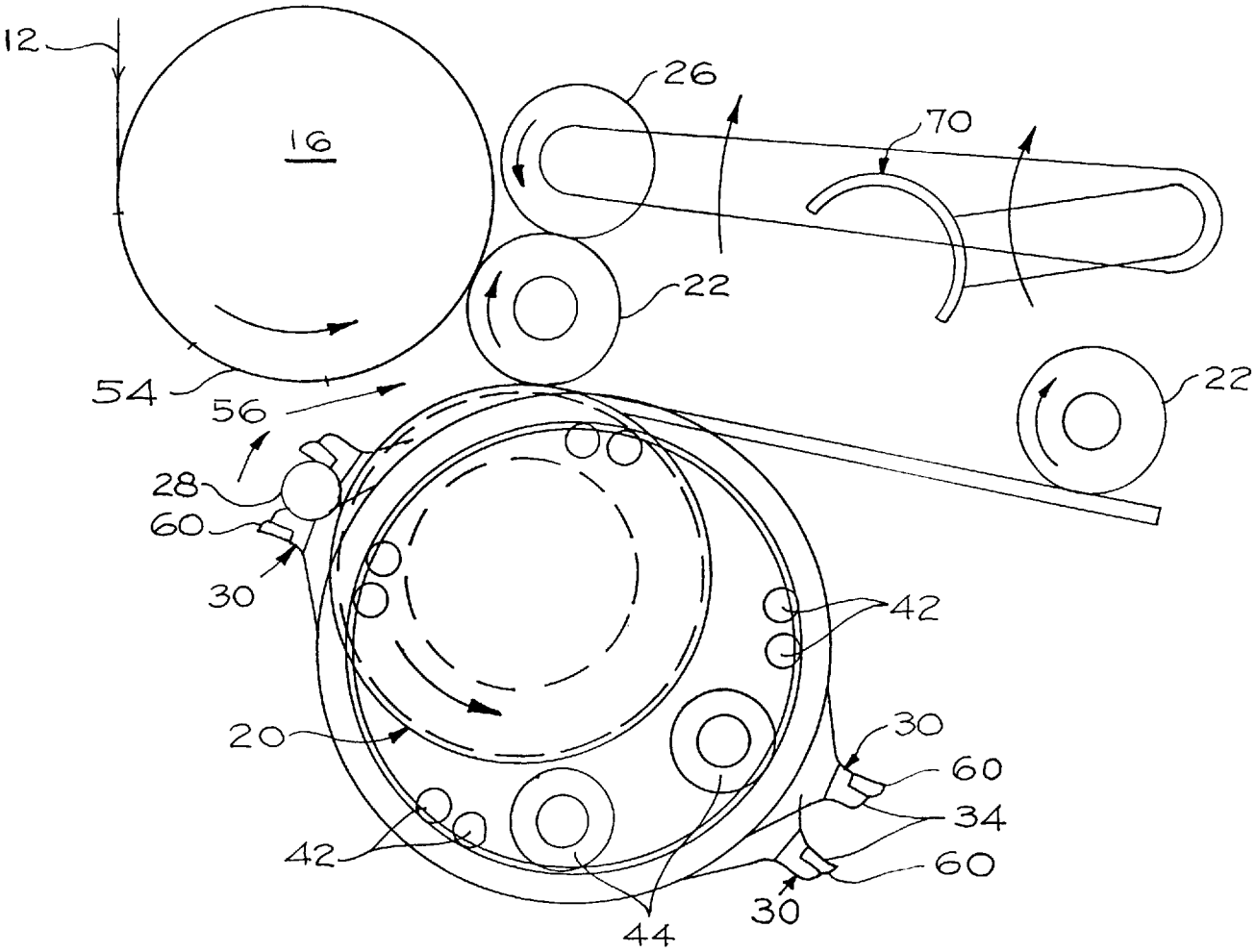
FIG. 5 illustrates an enlarged side view of the rewinder shown in FIGS. 1–4 prior to web separation.

Referring now to FIG. 5, a log 22 is shown nearing completion of winding in a cradle 24 formed between the two winding rolls 16, 20 and the rider roll 26. A core 28 is held in place between two winding control fingers 30, preferably by lightly squeezing the core 28 with the winding control fingers 30. The winding control fingers 30 accelerate the core 28 toward the nip 56 between the winding rolls 16, 20. The winding control fingers 30 and the core 28 preferably reach a speed somewhat less than the speed of the circumference 54 of upper winding roll 16.

Figure 6:
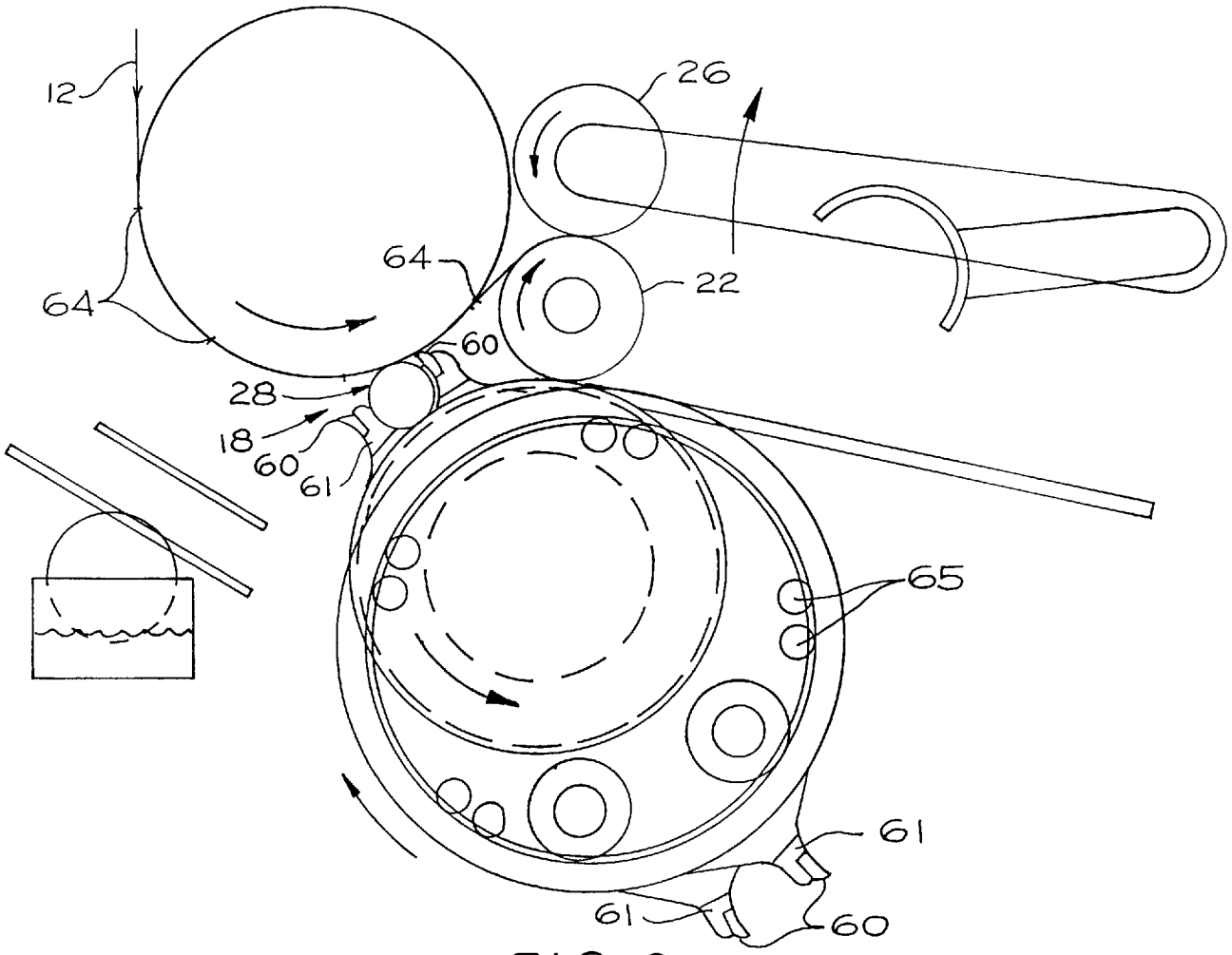
FIG. 6 shows an enlarged side view of the rewinder shown in FIGS. 1–5 during web separation.

Referring now to FIG. 6, a resilient tip 60 on the winding control finger 30 ahead of the core 28 pinches the web 12 between the winding control finger 30 and the upper winding roll 16 at the nip 56 between the two winding rolls 16, 20. The tip 60 can comprise a variety of resilient or rigid materials and be mounted to a base of the winding control finger 30 in various ways. Preferably, the tip 60 comprises polyurethane having a durometer of between sixty and one hundred, and is held adjacent a metal base 61 with a metal tab 63. Alternatively, the tip 60 can be conventionally mounted directly to the base 61 or even serve as the entire winding control finger 30, provided a sufficiently durable material is used. In another preferred embodiment, the tip 60 is spring mounted to provide resilience. The preferred resilient nature of the tip 60 enables tolerances for the interference between the upper winding roll 16 and the tip 60 to be looser while maintaining product quality and performance.

Figure 2:
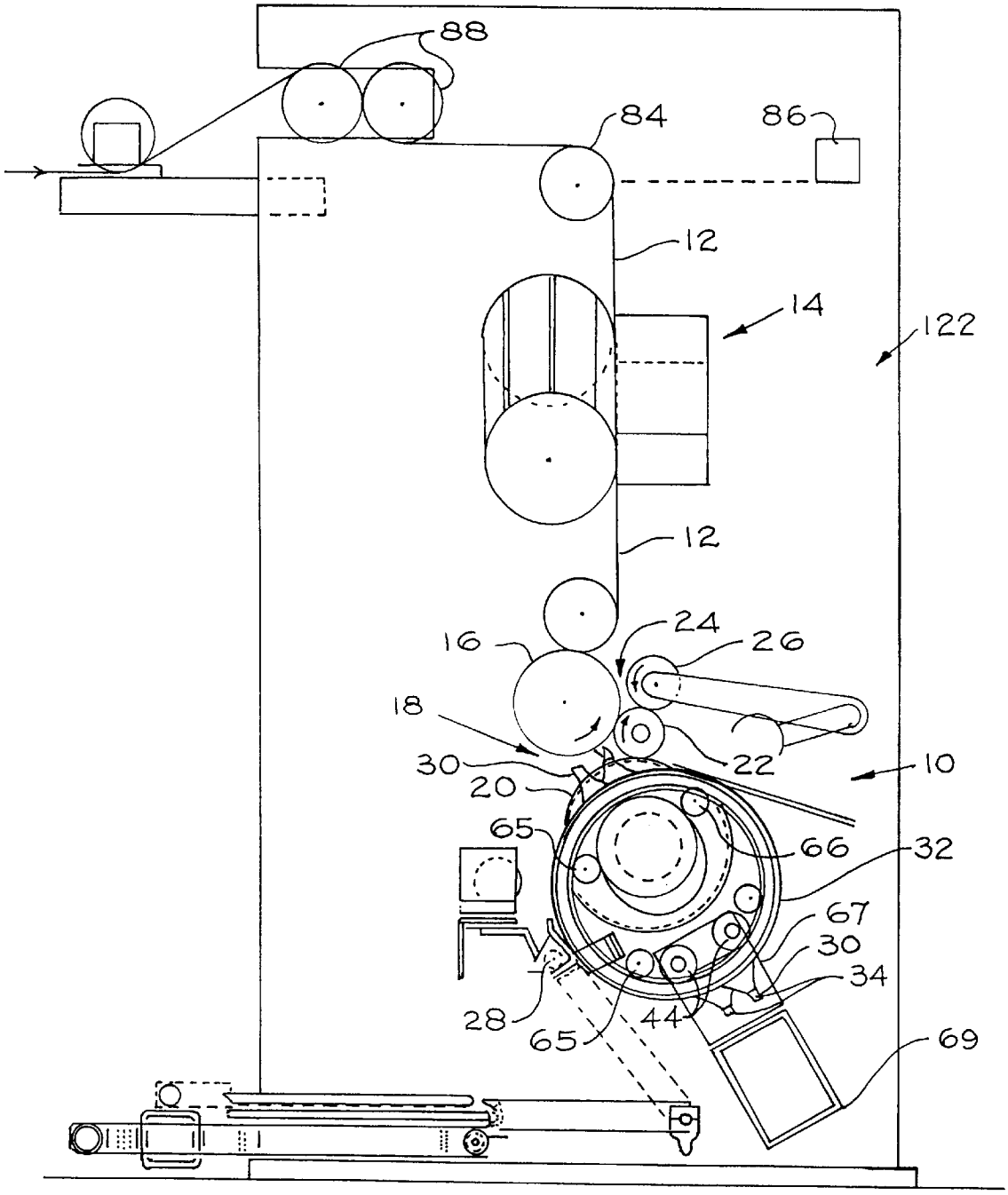
FIG. 2 illustrates a side view of the rewinder shown in FIG. 1.
Figure 3A:
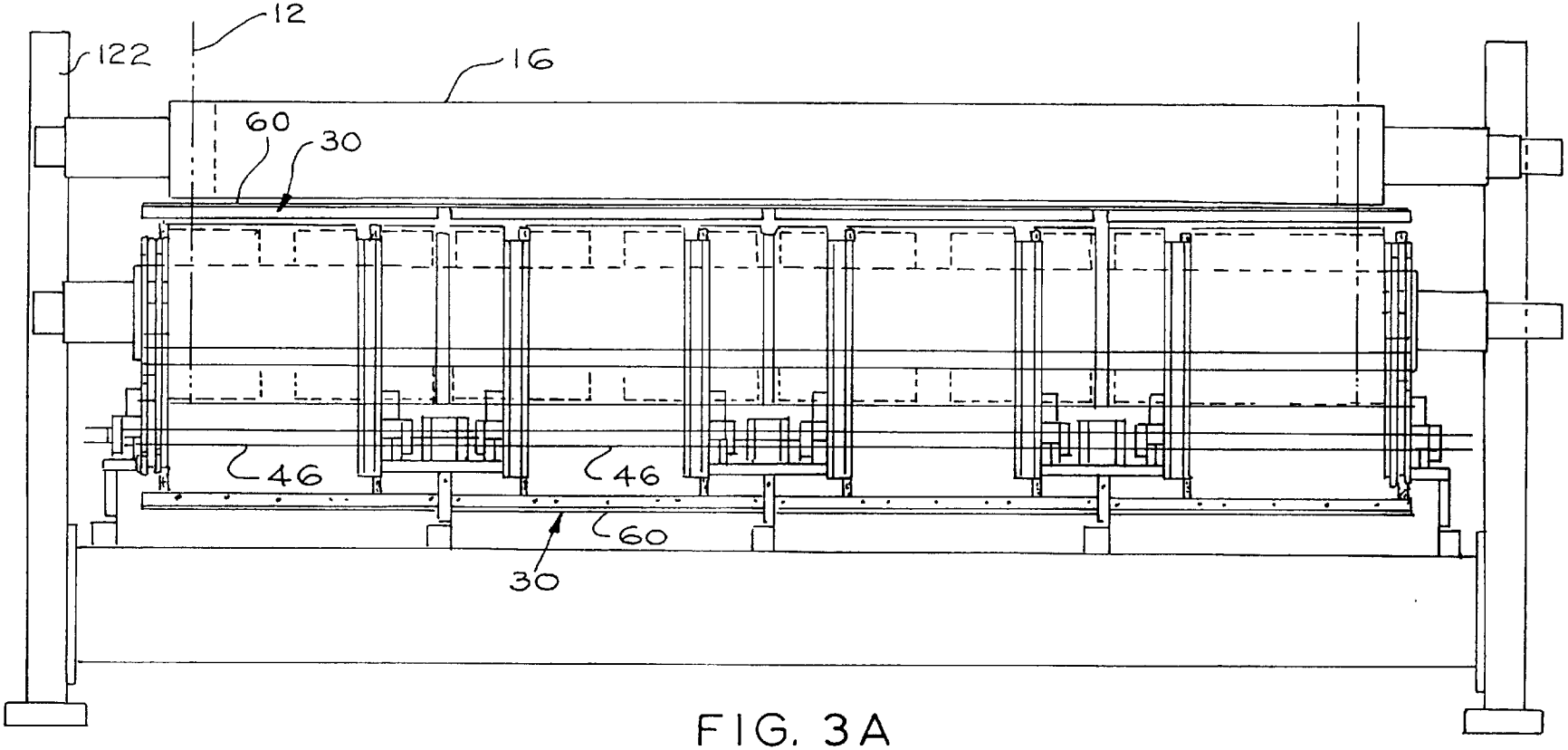
FIG. 3A shows a top view of the rewinder shown in FIGS. 1 and 2.
Figure 4A:
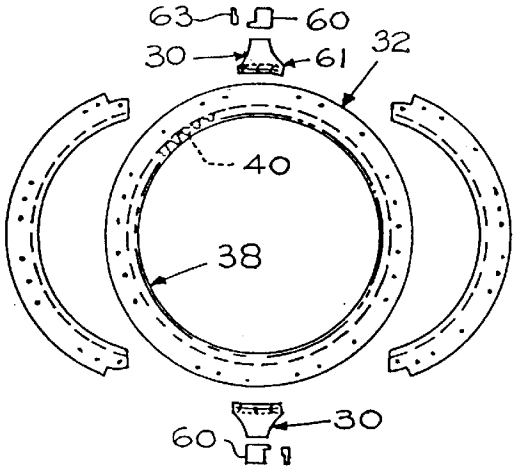
FIG. 4A shows a side view of the winding control fingers and ring structure generally shown in FIGS. 1–3.
Figure 4C:
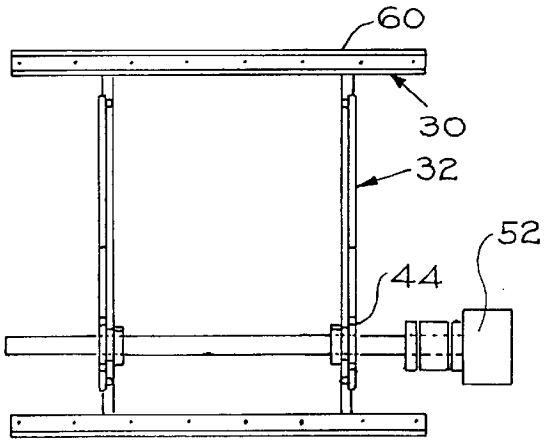
FIG. 4C shows a front view of the winding control fingers and ring support mechanism.
Figure 3C:
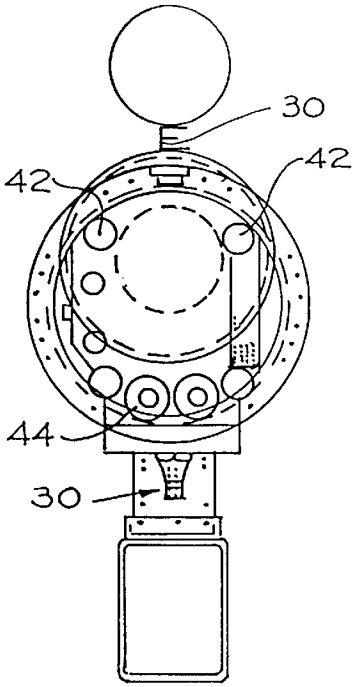
FIG. 3C shows a front elevation view of the winding control fingers supported by ring guide wheels and rotatably driven by a ring drive gear mechanism.
Figure 3B:
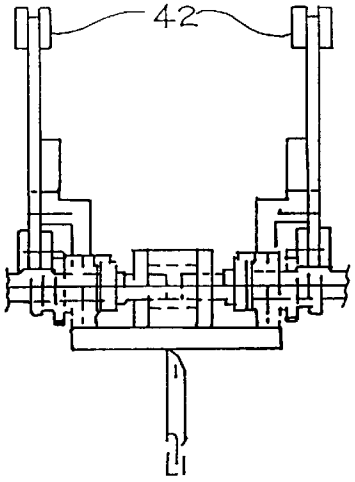
FIG. 3B illustrates a top view of the ring gear drive mechanism and ring support shown in FIGS. 1, 2 and 3A.
Figure 4B:
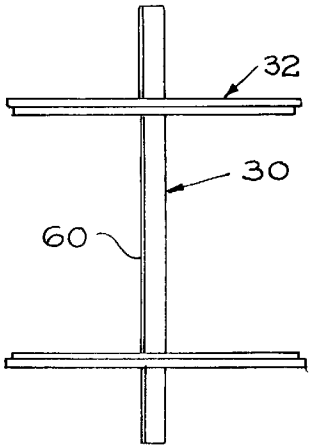
FIG. 4B illustrates a top view of the winding control fingers and ring structure generally shown in FIGS. 1–4A.
Figure 4F:
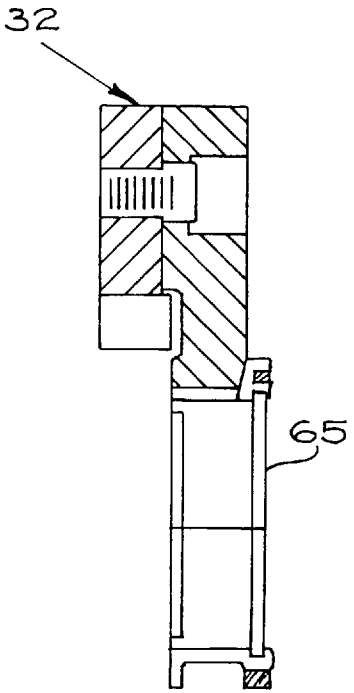
FIG. 4F illustrates a cross-sectional view of a pulley arrangement useful for supporting the ring structure.
Figure 4E:
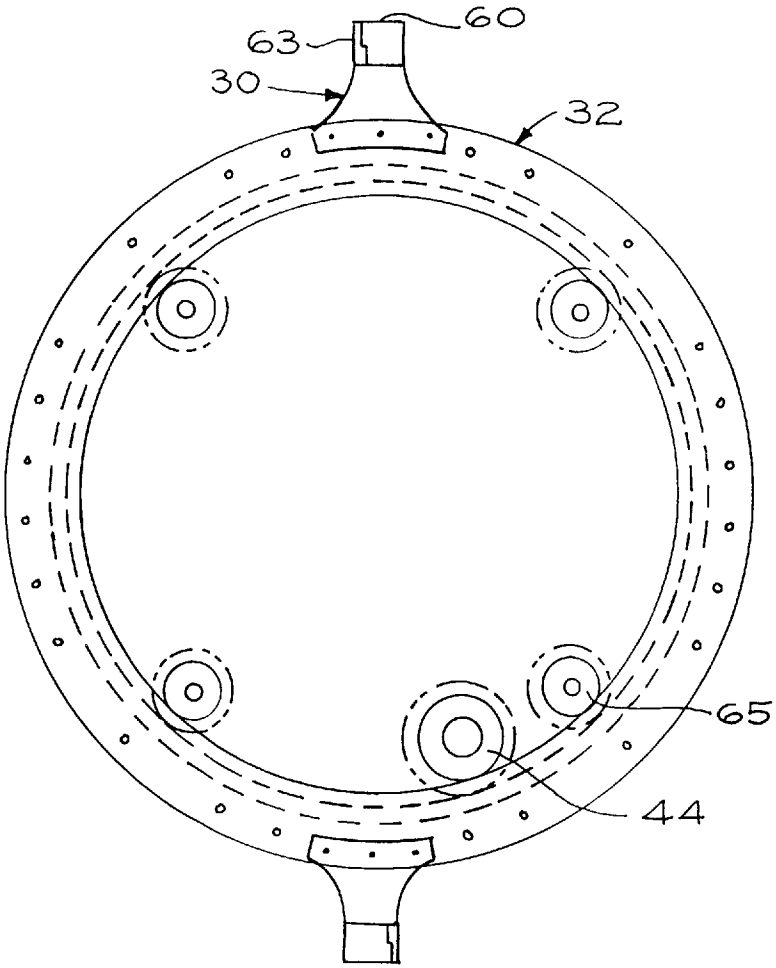
FIG. 4E shows an enlarged side view of the winding control fingers, ring structure and ring support and drive mechanism shown in FIGS. 1–3 and 4A–D.
Figure 4D:
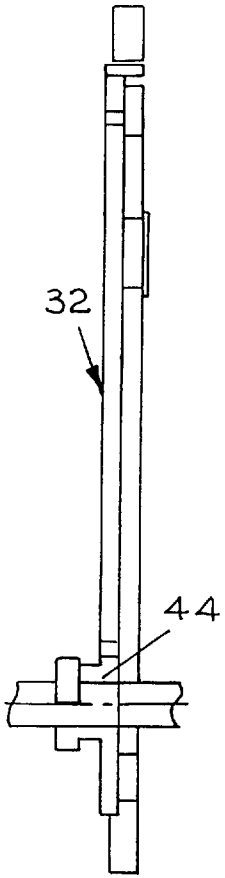
FIG. 4D illustrates a cross-sectional view of the winding control fingers and ring support mechanism.

The interference between the upper roll 16 and the tip 60 can be adjusted in a variety of ways. One preferred adjustment method includes resiliently mounting the rings 32 to compensate for the rings 32 not being perfectly round. Preferably, two support rollers 65 which do not bear a majority of the weight of the ring 32 are resiliently mounted, while one or more primary load bearing support rollers 66 are fixed. While a variety of ring system supports can be used to mount the support rollers 65, 66, preferably a yoke-shaped ring system support 67 is used as shown in FIG. 2. Alternatively, a control system can adjust the interference by varying the ring 32 location in various ways such as moving one or more of the support rollers 65, 66 or a base 69 supporting the support rollers 65, 66. This system can automatically or manually adjust the interference (primarily radially) to compensate for wear of the tip 60.

The winding control finger 30 is preferably timed to contact the web 12 at a position between perforations 64. At the point of contact with the winding control finger 30, the web 12 slows to the winding control finger 30 speed, and slips on the upper winding roll 16 due to the high coefficient of friction between the winding control finger 30 and the web 12. Tension in the web 12 between the winding control finger 30 and the log 22 increases above the tensile strength of the perforation 64 in the web 12. Because the winding control finger 30 is so close to the log 22 when the winding control finger 30 contacts the web 12, only one perforation 64 exists between the winding control finger 30 and the nip 56 between the log 22 and the rider roll 26. This single perforation 64 in this area of high tension assures that the web 12 will separate on the desired perforation 64 as compared to winders that must locate several perforations in this area. This highly controlled separation of the web 12 assures that each log 22 has the desired number of sheets, substantially reducing costs of surplus sheets commonly required by prior art devices.

The width of the throat 18 between the winding rolls 16, 20 is preferably set just smaller than the diameter of the core 28 so that the core 28 contacts both winding rolls 16, 20 just as the leading winding control finger 30 pinches the web 12 against the upper winding roll 16. At this point, the core 28 is trapped on all sides with winding rolls 16, 20 above and below the core 28 and winding control fingers 30 ahead and behind the core 28.

By trapping the core 28 on all four sides as the core 28 first contacts the surface of the winding rolls 16, 20, the core 28 is positioned straight and in-line with the winding rolls 16, 20 even if the core 28 was not straight to begin with. This solves a problem with prior art rewinders which commonly start the core 28 misaligned due to a lack of control on the fourth side of the core 28.

Slack in the web 12 develops in the small space between the winding control finger 30 ahead of the core 28 and at the core 28 itself. The slack is created because the core 28 is now rotating between the upper and lower winding rolls 16, 20 and driving the web 12 at the surface speed of the upper winding roll 16, and the winding control finger 30 is reducing the speed of the web 12 just in front of the core 28. The slack web 12 is now forced to follow the only path open to it, which is down toward the lower winding roll 20 between the core 28 and the winding control finger 30.

Figure 7:
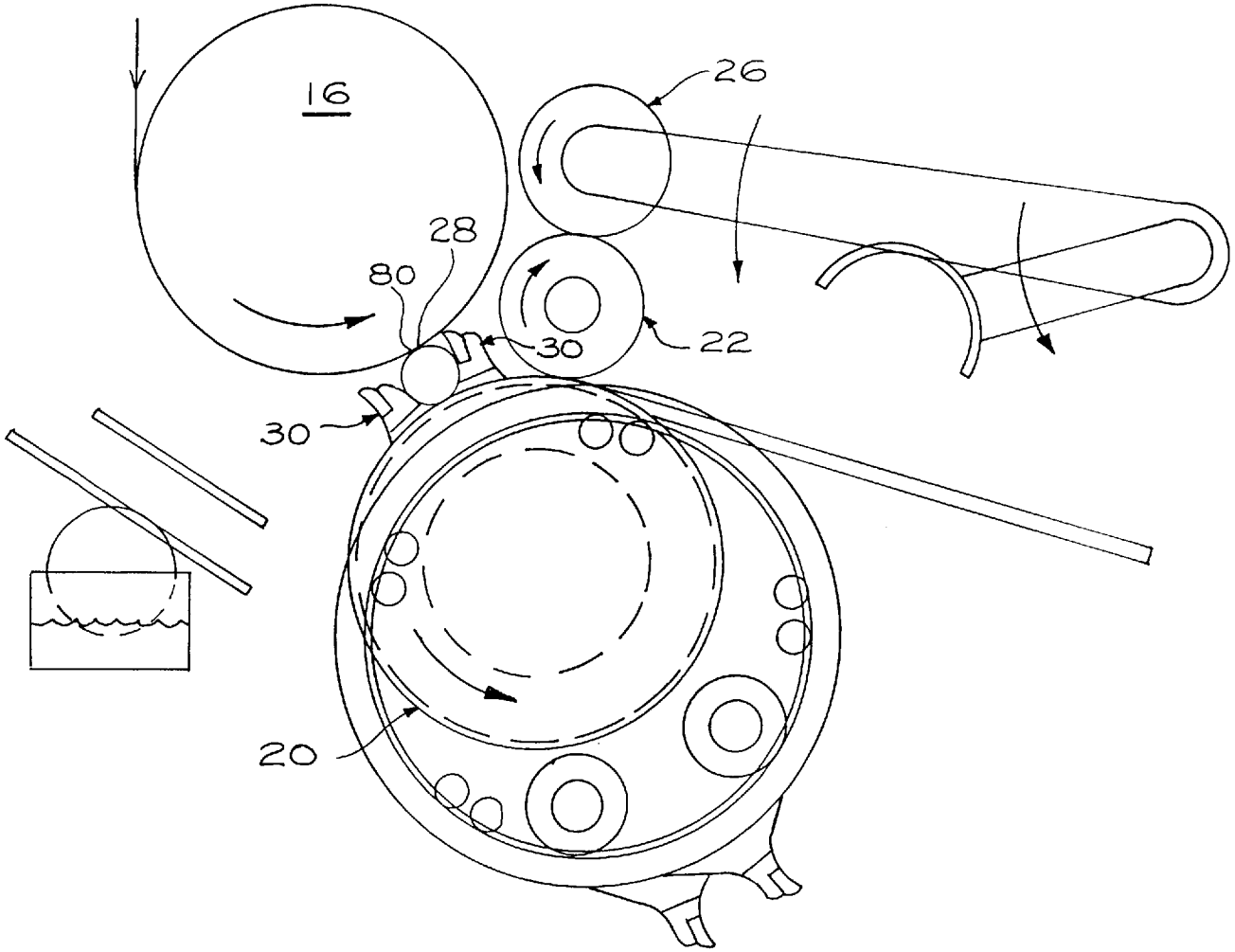
FIG. 7 illustrates an enlarged side view of the rewinder shown in FIGS. 1–6 just after web separation.

Referring now to FIG. 7, when the slack web 12 contacts the lower winding roll 20, its rotation forces the web 12 back between the core 28 and the lower winding roll 20. The winding control finger 30 ahead of the core 28 is now moving past the narrowest point in the throat 18. Contact between the tip 60 of the winding control finger 30 and the upper winding roll 16 now ceases and the end of the web 12 can now be pulled back under the core 28. As the web 12 passes back between the core 28 and the lower winding roll 20, it will contact the winding control finger 30 following the core 28 and be directed back up toward the area between the core 28 and the upper winding roll 16 to start the winding process. This process of starting the web 12 around the core 28 is made more reliable by the way the core 28 is trapped by the winding control fingers 30, and the way the winding control fingers 30 guide the web 12 around the core 28. The present invention will work without transfer adhesive 80 on the core 28. However, a higher maximum rewinding speed can be achieved by depositing a line of conventional adhesive 80 along the length of the core 28, rings of adhesive 80 on the circumference of the core 28 or other conventional adhesive configurations.

Figure 8:
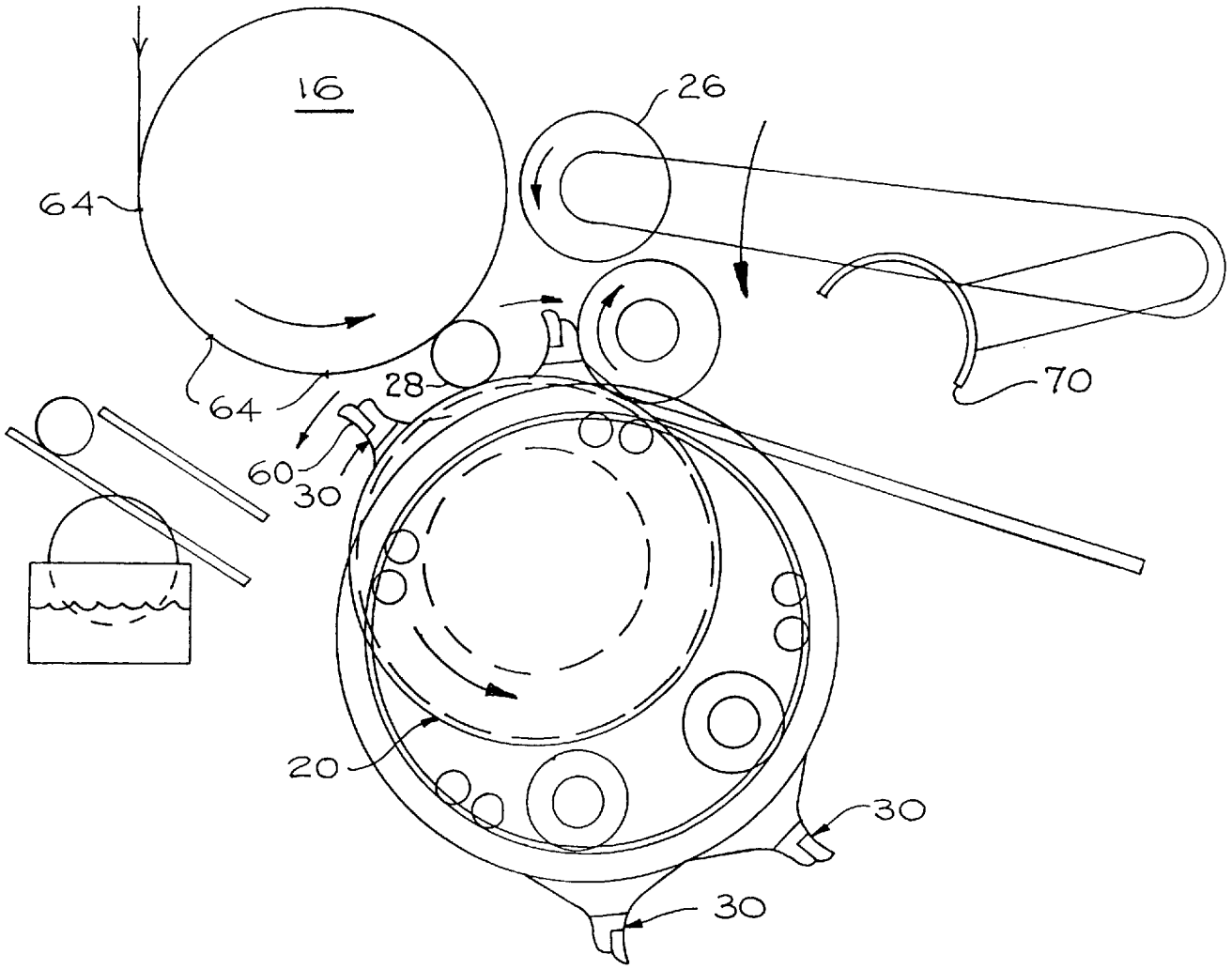
FIG. 8 shows an enlarged side view of the rewinder shown in FIGS. 1–7 after a new log has started rewinding and a wound log is being removed from the rewinding station by a winding control finger.

Referring now to FIG. 8, it is common practice in bathroom tissue and kitchen towel winding to run product as soft (low density) as possible at as high a speed as possible. The soft log 22 rotating at a high speed is unstable and its behavior is unpredictable when released from a conventional three-roll winding cradle. In prior rewinders, the maximum speed that the soft products can run is often limited by this unpredictable behavior of the log 22 as it exits the rewinder 10. In the present invention, this control problem is solved by the winding control finger 30 which is positively located between the new core 28 and the completed log 22. The winding control finger 30 continues through the throat 18 between the winding rolls 16, 20, contacts the completed log 22 and then guides the completed log 22 out of the three-roll cradle 24 and into a suitable conventional deceleration device 70.

Around this point in time, the web 12 is wrapping the new core 28 in the throat 18 between the winding rolls 16, 20 and the diameter of the new log 22 is increasing. To prevent crushing the core 28, the lower winding roll 20 can be slowed down momentarily to move the core 28 through the throat 18 between the winding rolls 16, 20 toward the cradle 24. Because the winding control finger 30 moves the completed log 22 out of the three-roll cradle 24 rapidly, the rider roll 26 can quickly move down toward the log 22 emerging from the throat 18 between the winding rolls 16, 20 (see FIG. 9). This minimizes the time the log 22 is balancing between the upper winding roll 16, 20 and lower winding roll 20 by quickly getting the log 22 into the three-roll cradle 24. By reducing the time the log 22 is balanced between winding rolls 16, 20 and increasing the time the log 22 is in the three-roll cradle 24, the log 22 is better controlled and the speed change in the lower winding roll 20 is less critical than in previous rewinders.

Figure 9:
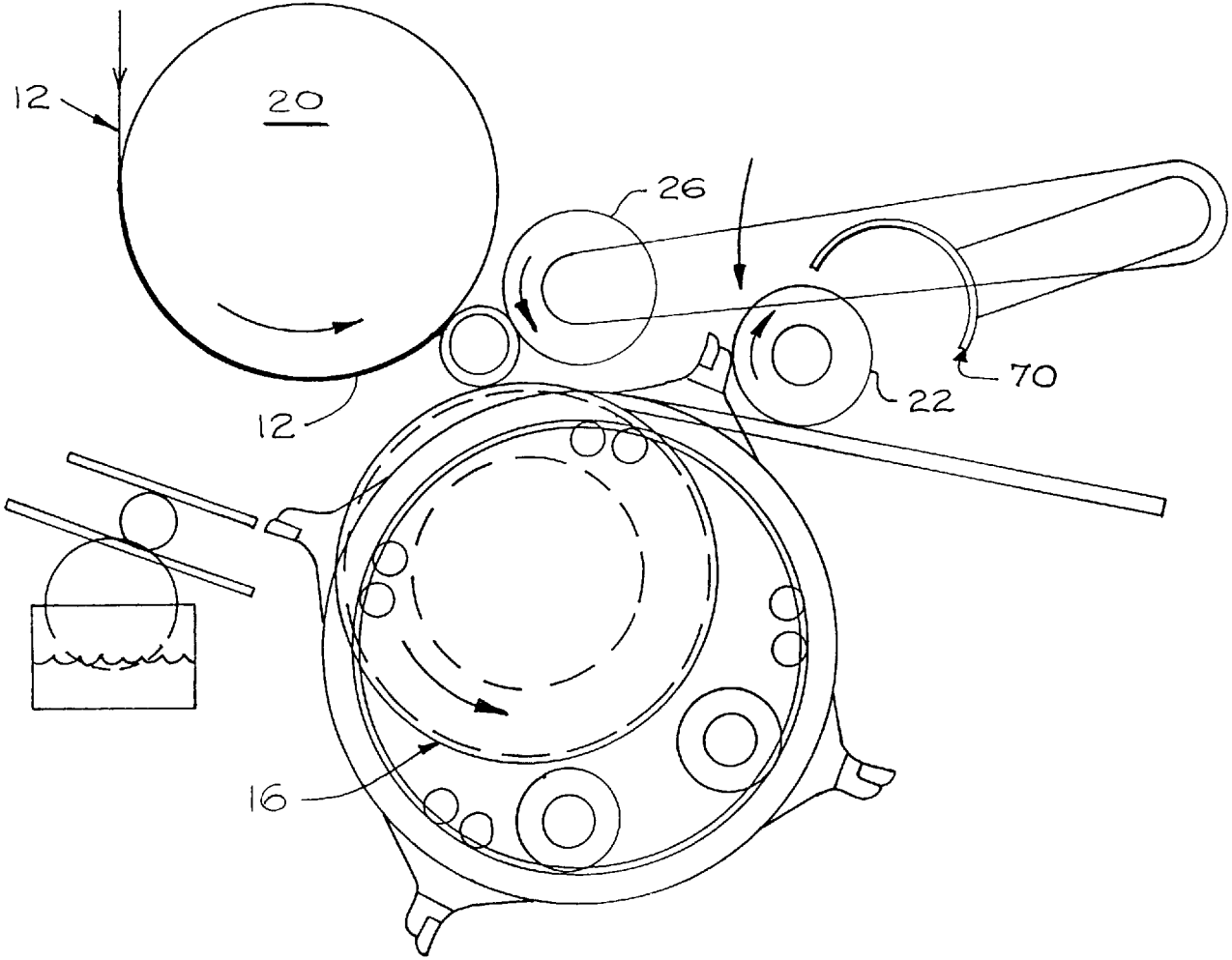
FIG. 9 illustrates an enlarged side view of the rewinder shown in FIGS. 1–8 rewinding the new log and moving the wound log under a deceleration hood with a winding control finger.
Figure 10:
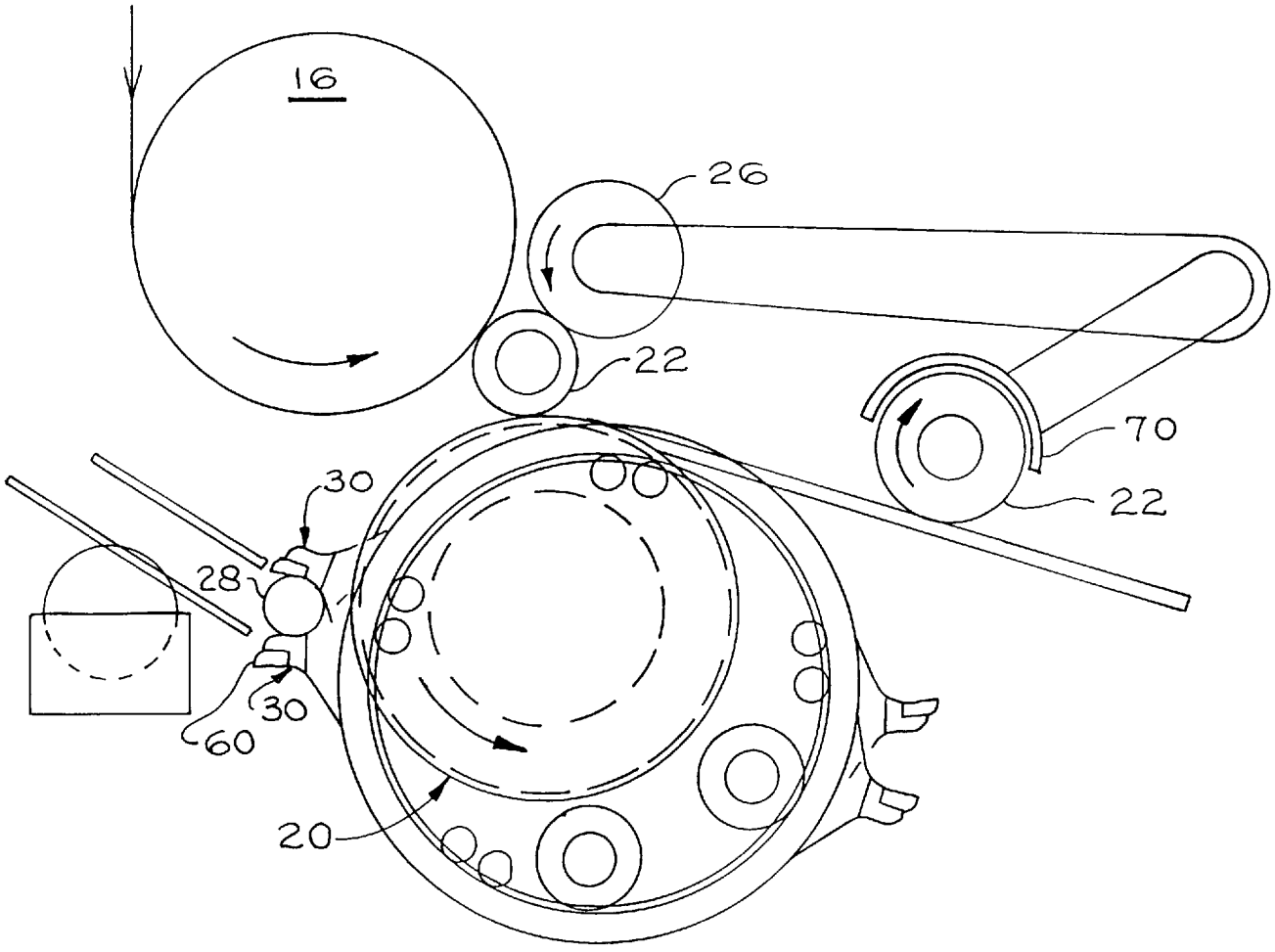
FIG. 10 shows an enlarged side view of the rewinder shown in FIGS. 1–9 preparing a new core for rewinding, winding a log and decelerating a wound log in a step of the process just prior to the step shown in FIG. 5.
Figure 11:
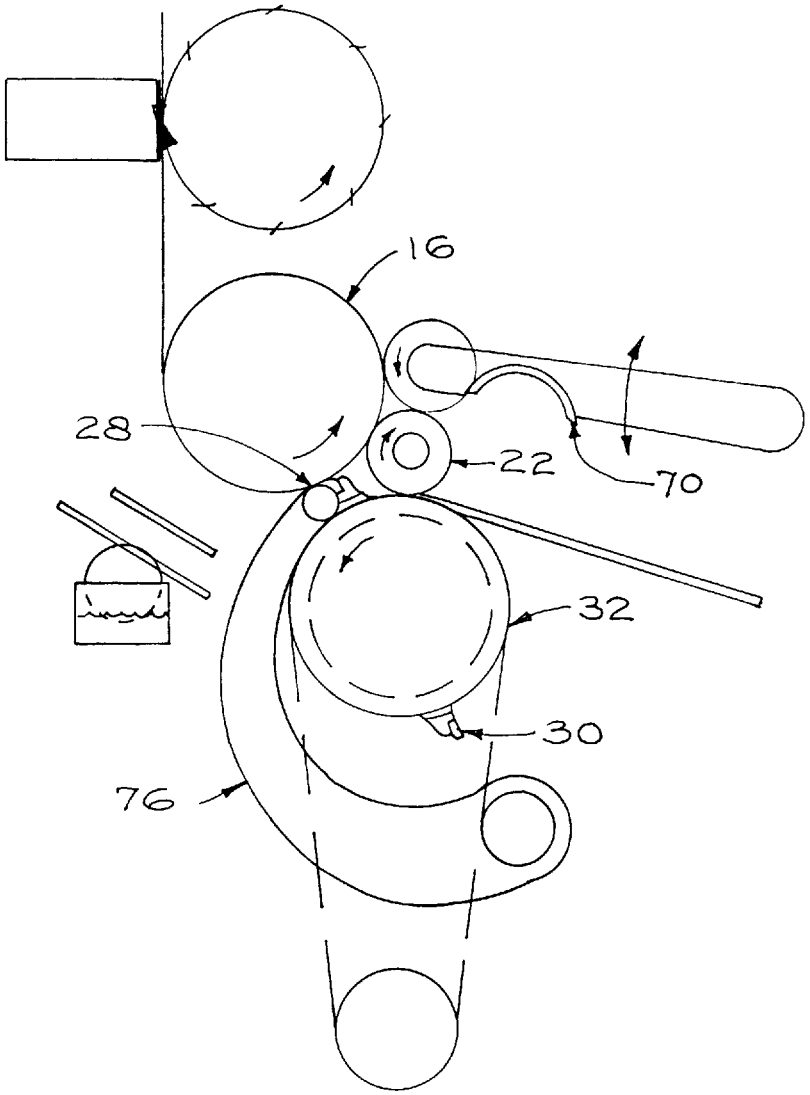
FIG. 11 illustrates a side view of an alternative embodiment of the invention using one winding control finger to separate the web and a core insertion device inserting cores.
Figure 12:
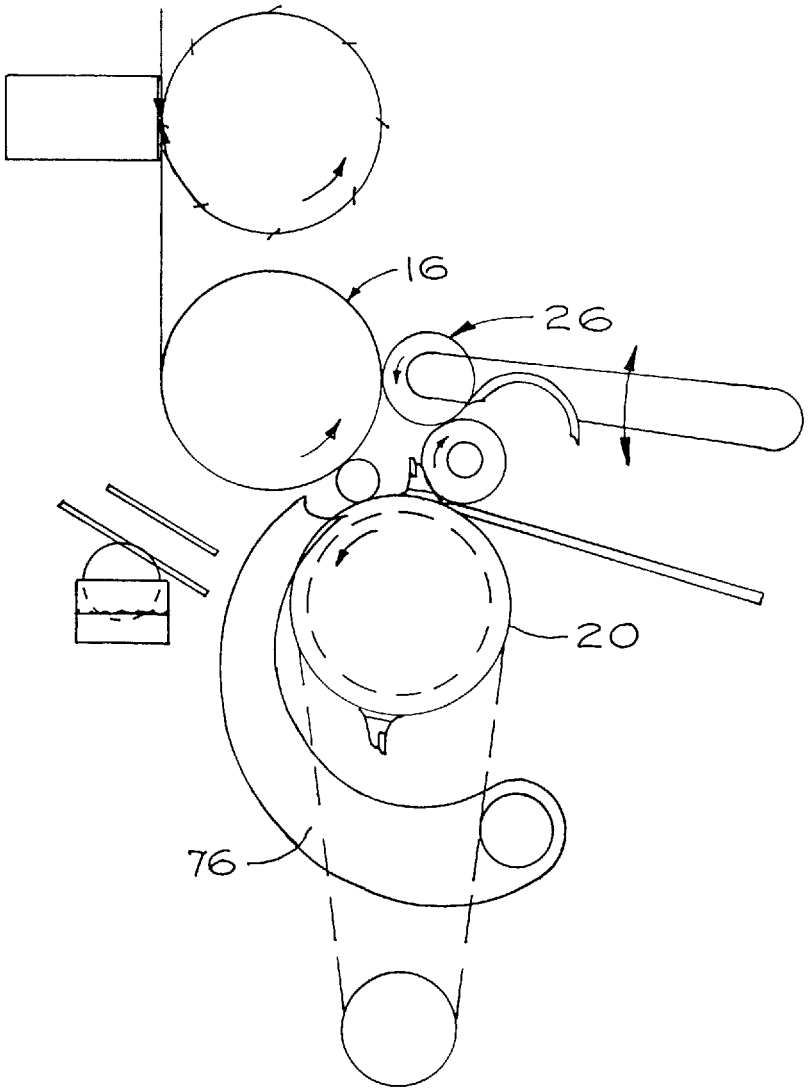
FIG. 12 shows a side view of the rewinder shown in FIG. 11 after core insertion.
Figure 13:
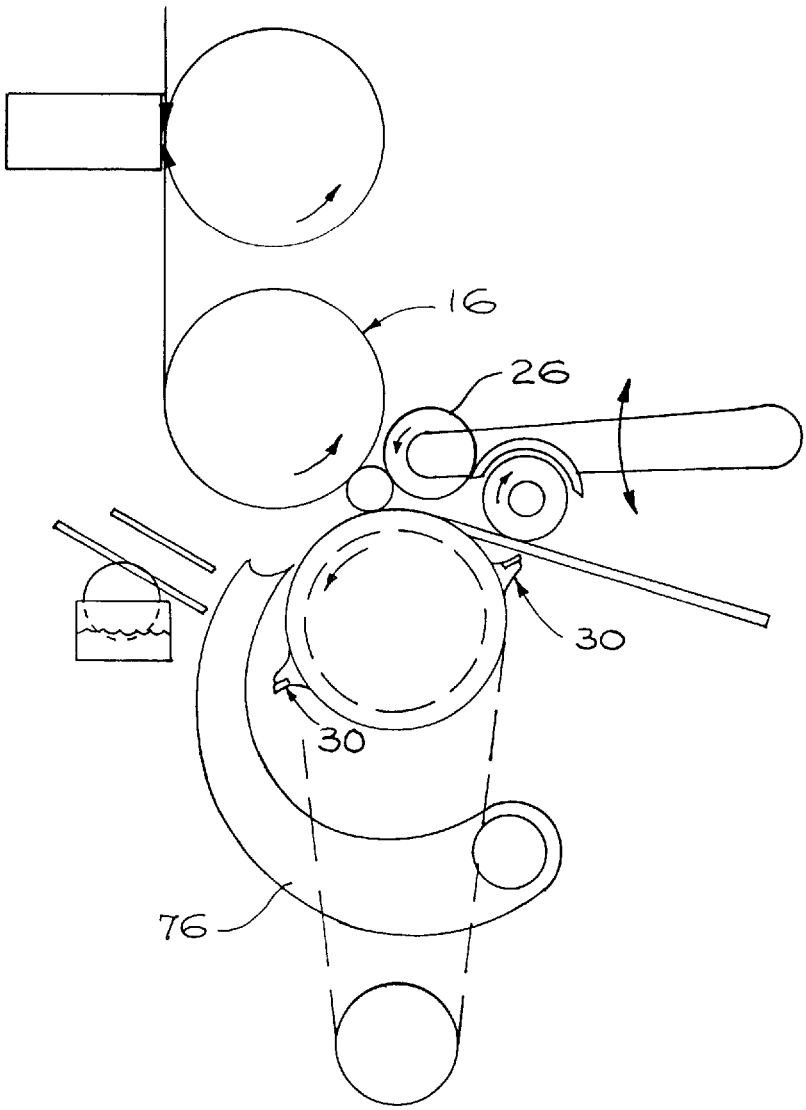
FIG. 13 illustrates a side view of the rewinder shown in FIGS. 11 and 12 after rewinding has started on the new core.
Figure 14:
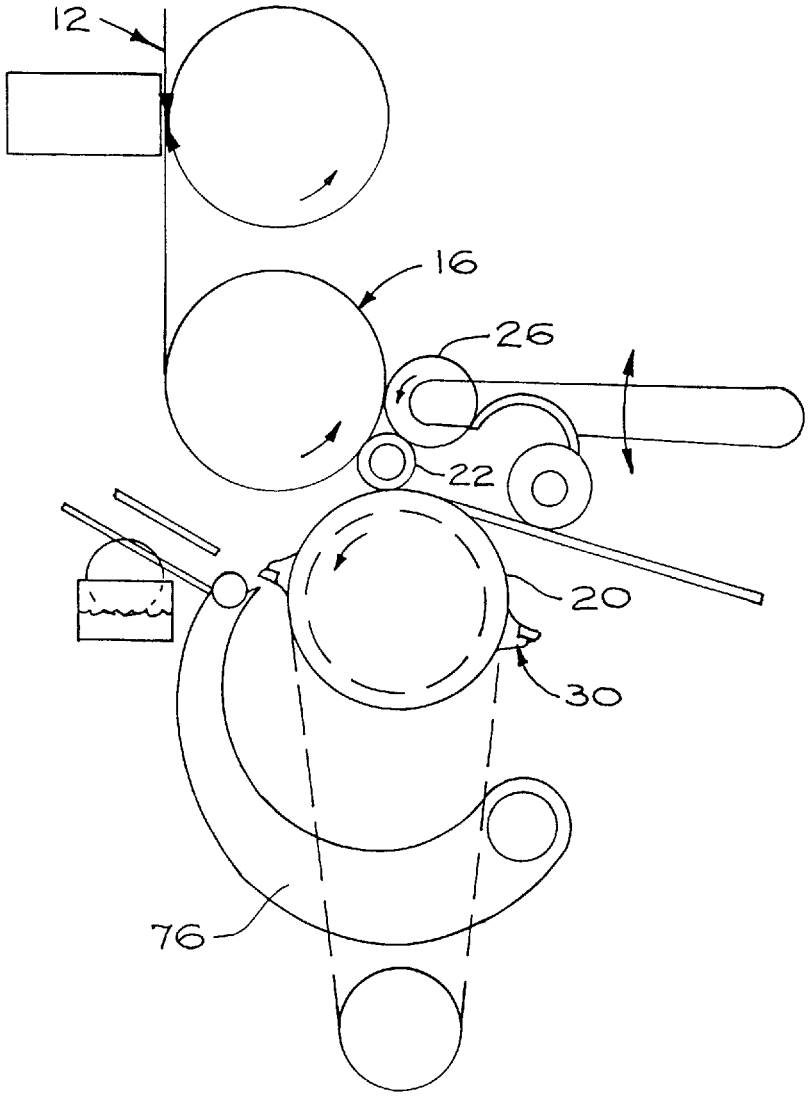
FIG. 14 shows a side view of the release of a wound log from the rewinder shown in FIGS. 11–13.
Figure 15:
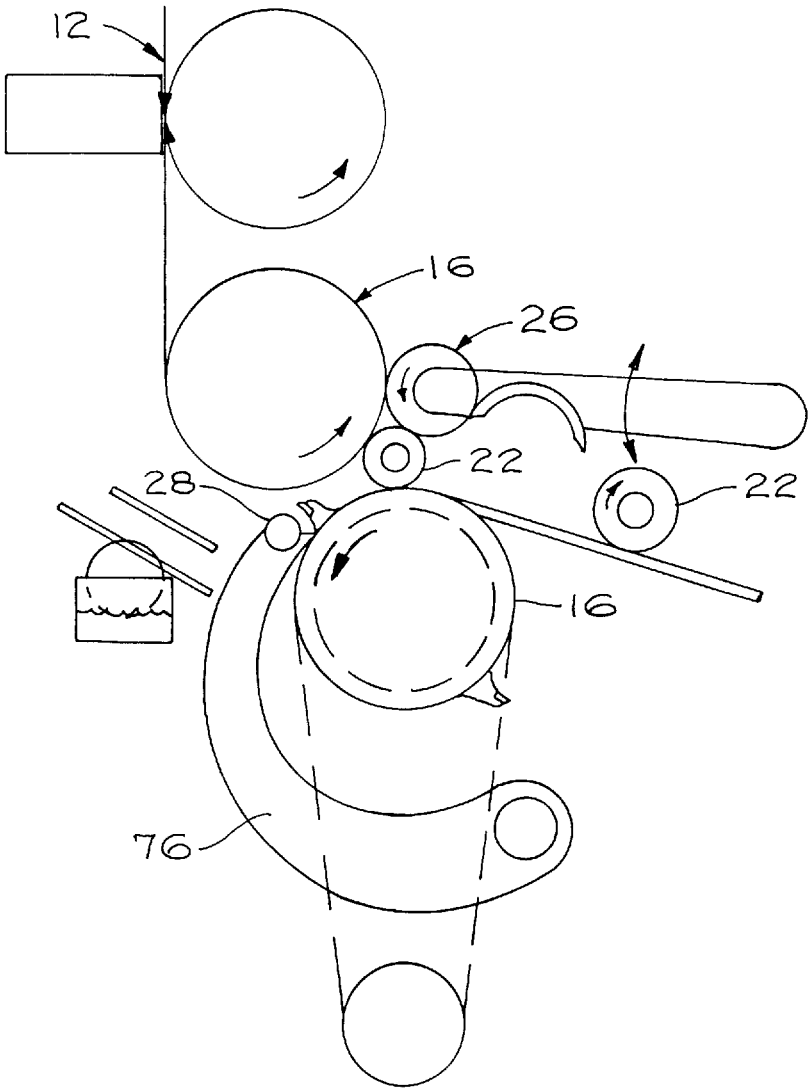
FIG. 15 illustrates a side view of the rewinder shown in FIGS. 11–14 in a step of the process just prior to the step shown in FIG. 11.

The winding control finger 30 that was behind the core in FIG. 7 preferably has reversed direction in FIG. 8 and has moved down to the point at which a new core 28 is picked up as shown in FIGS. 9 and 10. Alternatively, another winding control finger 30 can pick up a new core 28.

Referring now to FIG. 10, the winding control finger 30 which was guiding the completed log 22 to the deceleration device 70 has completed its cycle in the winding process. The winding control finger 30 continues to move until the winding control finger 30 mounted about 180 degrees from the first on the same support ring 32 is in place at the core pick-up point to receive the next core 28. When the core 28 arrives, two sets of winding control fingers 30 squeeze the core 30 and move the core 30 toward the nip 56 between the winding rolls 16, 20 which completes the steps of the process. After this step, the process can continue starting with the step shown in FIG. 5.

Another preferred embodiment of the invention includes a rewinder 10 with a single set of winding control fingers 30 and a core insert arm 76 as shown in FIGS. 11–15. The embodiment has the advantage of half the number of winding control fingers 30 and rings 32, but requires a separate core insert mechanism which is more complex than the winding control finger systems.

Figure 16:
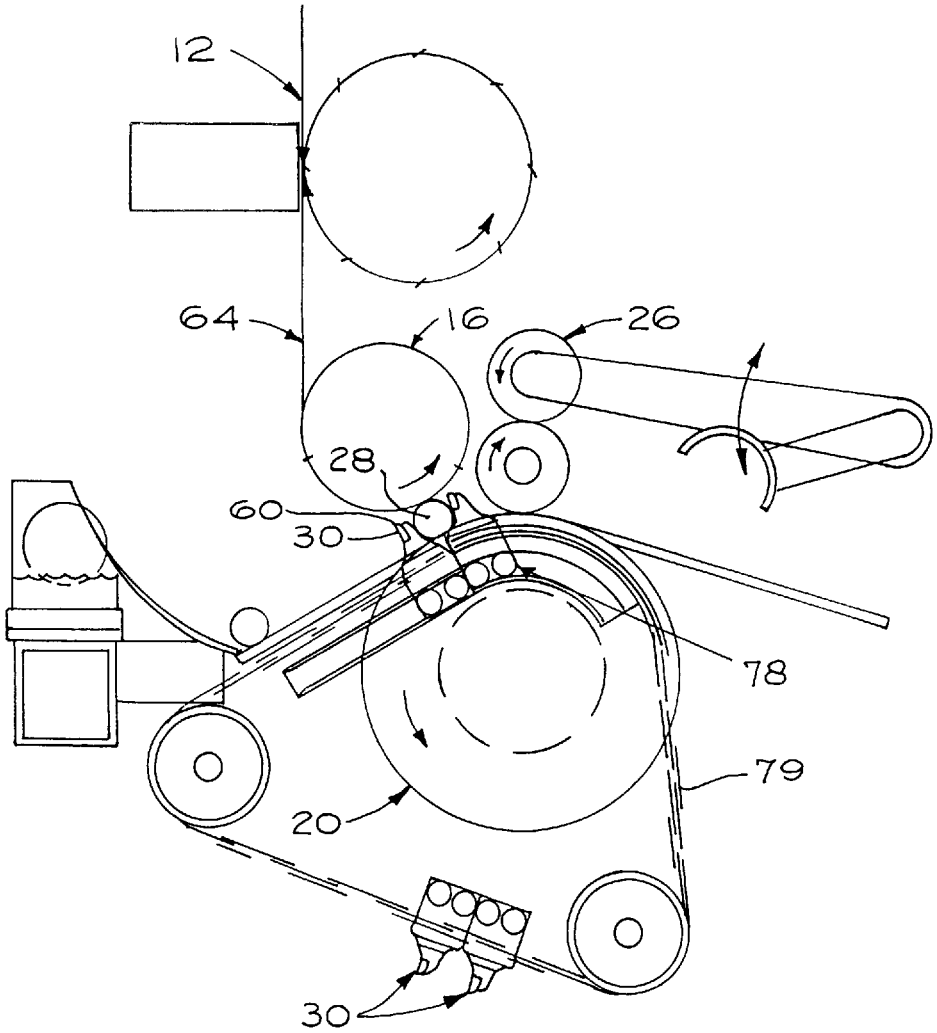
FIG. 16 shows another alternative embodiment of the invention using roller chain to carry winding control fingers.

FIG. 16 shows a rewinder 10 with a system of winding control fingers 30 mounted on cam followers 78 and driven by roller chains 79. This concept has the advantage over the ring-based design of ease of installation and removal of the winding control finger system, but the significant disadvantage of high maintenance associated with the chains 79 and cam followers 78.

In another preferred embodiment of the invention, an idler roll 84 above the upper winding roll 16 irons the web 12 down onto the upper winding roll 16 as shown in FIG. 2. The idler roll 84 is useful at high speeds to drive air out from between the web 12 and the upper winding roll 16. The idler roll 84 can also be used to sense tension in the web 12. The web tension signal can feed a tension control system 86 which adjusts the speed of a set of pull rolls 88 which are located above the conventional perforation station 14.

Other preferred embodiments of the invention include an upper winding roll 16 that is reduced in diameter to reduce the distance the core 28 needs to move as it passes through the nip 56 between the rolls 16, 20. The lower winding roll 20 can be increased in diameter to provide more room in the grooves 50 that the rings 32 ride in. This room is useful to allow the lower winding roll 20 to adjust to a larger range of core diameters without exposing the rings 32 in the cradle 24. The rings 32 were made larger to provide room for the ring support system 67.

A variety of methods and apparatus for supplying and gluing cores 28 can be used, although one method and apparatus is shown for illustrative purposes. The illustrated design significantly reduces the number of core handling parts common to these systems by using the winding control finger 30 to perform multiple functions.

In accordance with another preferred embodiment of the invention shown in FIGS. 17–20, the winding control finger rewinder 10 can be used to rewind coreless products reliably at high speeds. The rewinder 10 uses a number of mandrels 100 which cycle through the rewinder 10 and are returned by a mandrel handling system 102 to the starting point.

Figure 17A:
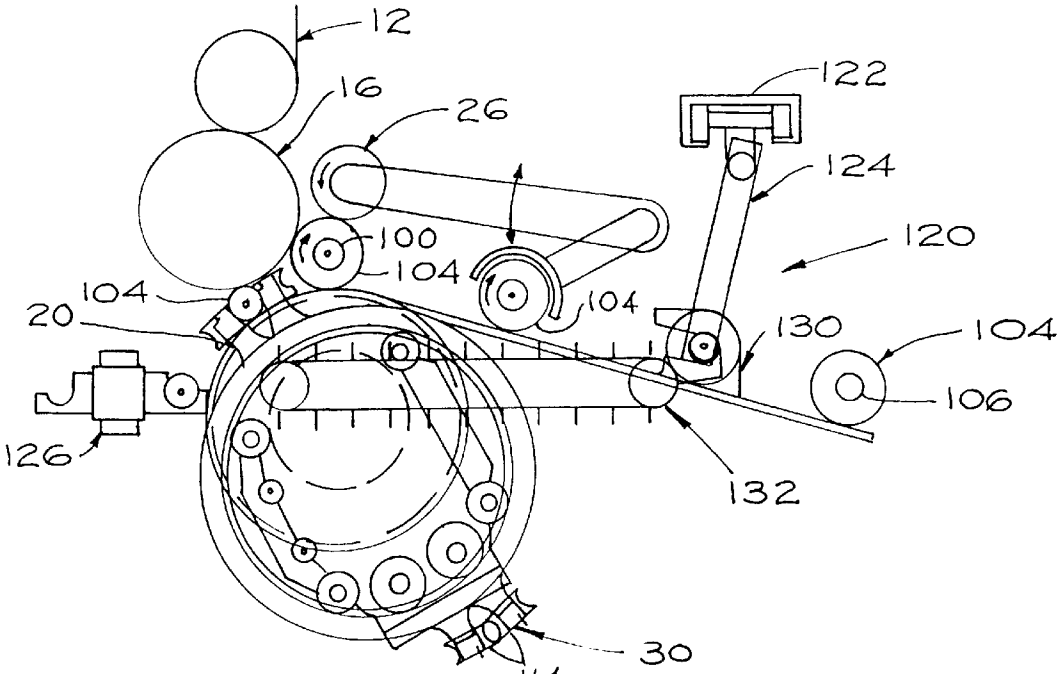
FIG. 17A illustrates a side view of an alternative embodiment of the invention for producing a coreless product.
Figure 17B:
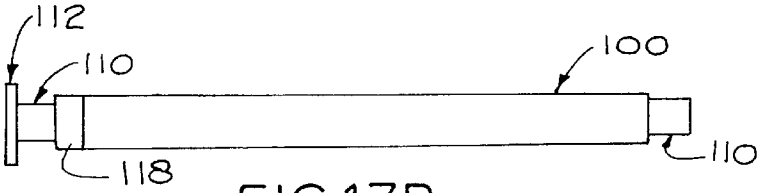
FIG. 17B shows a front view of a mandrel useful in this alternative embodiment.
Figure 17C:
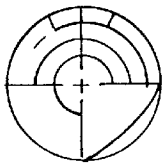
FIG. 17C illustrates an end view of the mandrel shown in FIG. 17B.

The coreless product 104 is wound on one of the mandrels 100 and then the mandrel 100 is removed from the center of the coreless product 104, leaving a hole 106 at the center. The center hole 106 ensures product compatibility with conventional wound product dispensers. Each mandrel 100 preferably includes a bearing 110 on each end as shown in FIG. 17B. The outside diameter of the bearings 110 is preferably less than the diameter of the mandrel 100. One end of the mandrel 100 preferably includes a flange 112 that is larger in diameter than the mandrel 100. The flange 112 is used to pull the mandrel 100 out of the coreless product 104.

The winding control fingers 30 include a mandrel bearing support 114 on each end. The mandrel bearing supports 114 interact with each other to trap the bearings 110 on the mandrel 100 and support the mandrel 100 with a small gap between the mandrel 100 and the winding control fingers 30. The nip 56 between the upper and lower winding rolls 16, 20 is dimensioned slightly larger than the diameter of the mandrel 100. The bearing supports 114 on the winding control fingers 30 also guide the mandrel 100 through the nip 56 centered between the winding rolls 16, 20. The mandrel 100 preferably includes a friction drive area 118 near the flange 112 that contacts the lower winding roll 20 just before the nip 56 and drives the mandrel 100 during mandrel insertion.

The tip 60 of the lead winding control finger 30 separates the web 12 as described previously for other preferred embodiments of the invention. The web 12 is trapped between the two winding rolls 16, 20 and the two winding control fingers 30. As the web 12 collects behind the lead winding control finger 30, it contacts the spinning mandrel 100 and wraps the mandrel 100 to start the winding process. The remainder of the winding process is similar to that of the rewinder 10 with a core 28 at the center.

The coreless product 104 stops at the mandrel extraction area 120 after leaving the deceleration device of the rewinder 10. The mandrel 100 is pulled out of the coreless product 104 and outside of a machine frame 122 by a mandrel extractor 124. Once outside the frame 122, the mandrel 100 is picked up by a cross conveyor 132 that moves the mandrel 100 back to the area upstream of the lower winding roll 20. At this point, the mandrel 100 is moved back inside the frame 122 by the mandrel insert conveyor 126. The mandrel insert conveyor 126 holds the mandrel 100 in place for the winding control fingers 30 to pick up the mandrel 100 for insertion, completing the process for one mandrel 100. The rewinder 10 preferably uses five mandrels 100 at different stages in the winding process at all times.

Figure 18:
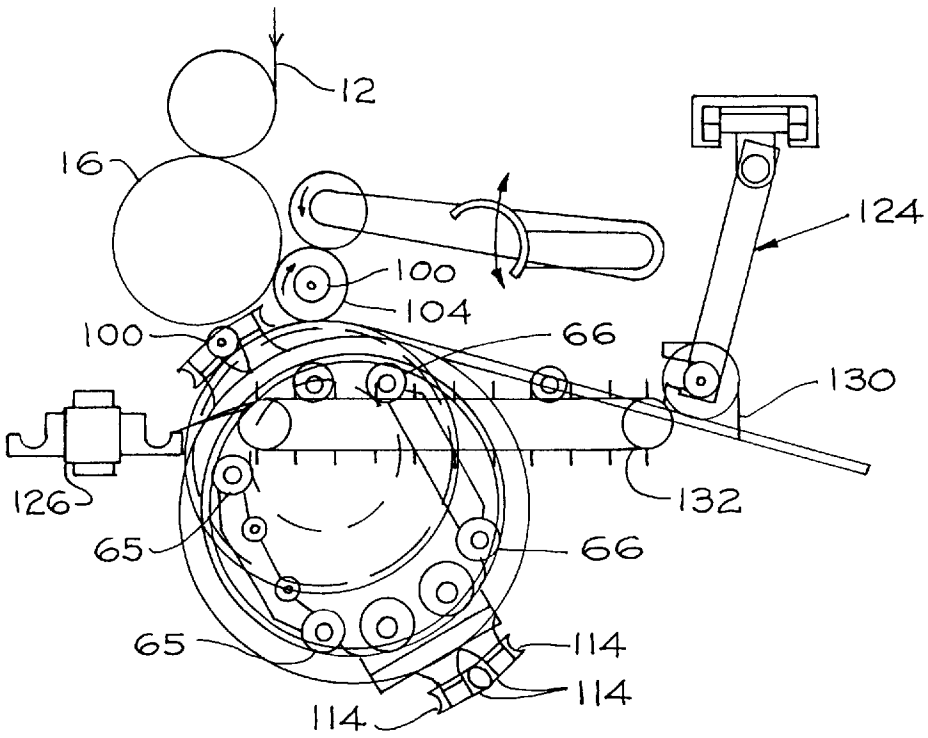
FIG. 18 shows a side view of the rewinder shown in FIG. 17 after mandrel insertion.

Referring to FIG. 18, one coreless product 104 is completing the winding process between the upper winding roll 16, the lower winding roll 20 and the rider roll 26. A mandrel 100 is about to be inserted into nip 56 between the upper and lower winding rolls 16, 20 by the winding control fingers 30. A completed coreless product 104 and mandrel 100 are at the mandrel extractor 124. The coreless product 104 will be held by a product stop 130 as the mandrel extractor 124 pulls the mandrel 100 out of the coreless product 104 and outboard of the frame 122. Two mandrels 100 are on the cross conveyor 132 which moves the empty mandrels 100 from the mandrel extractor 124 back to the mandrel insert conveyor 126.

Figure 19:
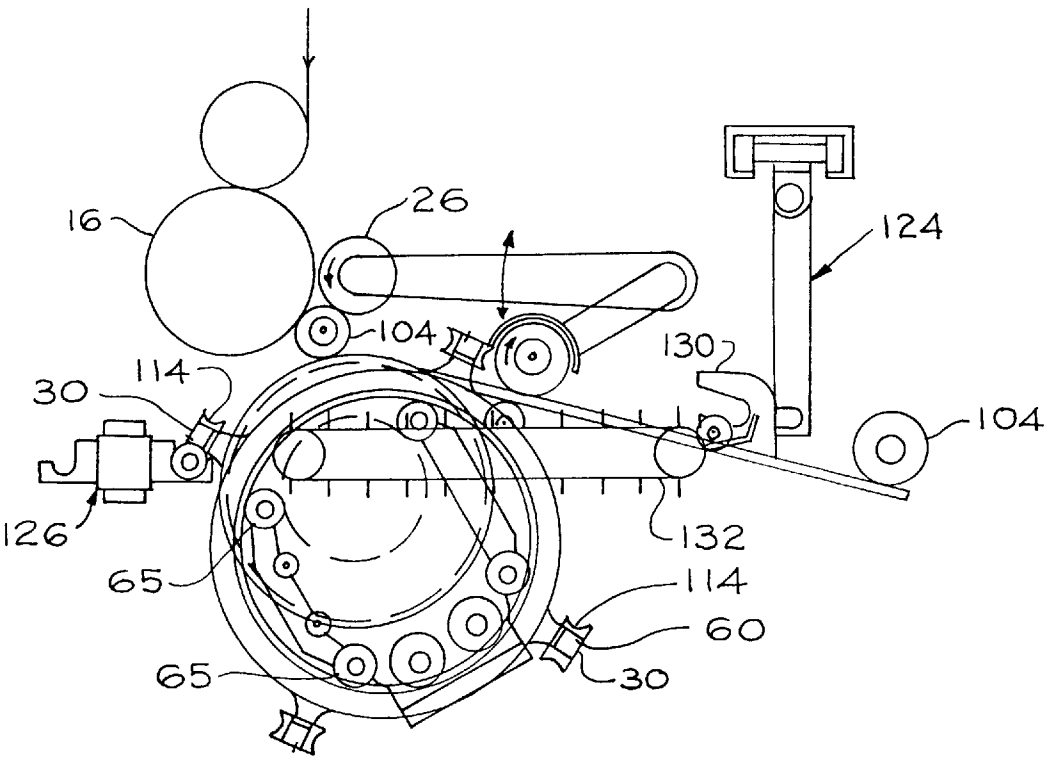
FIG. 19 illustrates a side view of the rewinder shown in FIG. 17 after rewinding has started on the new mandrel.

As shown in FIG. 19, the mandrel insert conveyor 126 is moving the mandrel 100 picked up off the cross conveyor 132 back inside the frame 122 and positioning the mandrel 100 for the winding control fingers 30 to pick it up. Another coreless product 104 is winding in the nip 56 between the two winding rolls 16, 20 and the rider roll 26. A completed coreless product 104 is in the deceleration area. The mandrel extractor 124 has completed pulling a mandrel 100 out of a coreless product 104 and left it for the cross conveyor 132 to pick up. One mandrel 100 is located on the cross conveyor 132 and a completed coreless product 104 is rolling out of the rewinder 10.

Figure 20:
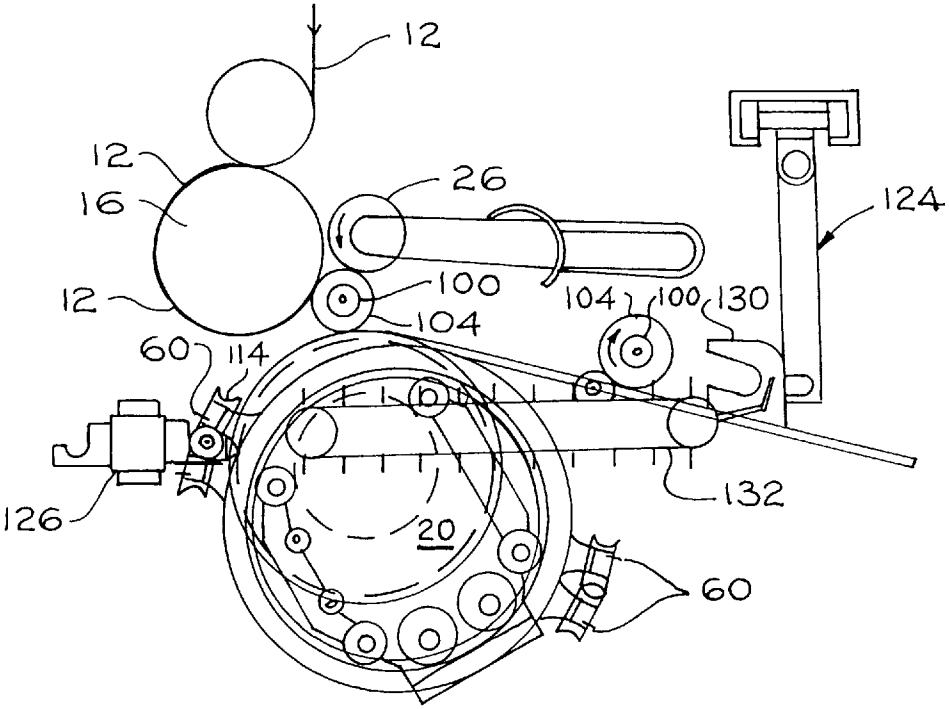
FIG. 20 shows a side view of the release of a wound log from the rewinder shown in FIG. 17.

Referring to FIG. 20, a mandrel 100 is being taken off the mandrel insert conveyor 126 by the winding control fingers 30. A coreless product 104 is winding in the nip 56 between the upper winding roll 16, the lower winding roll 20 and the rider roll 26. A coreless product 104 is rolling from the deceleration device 70 to the log stop to start the mandrel extraction process. Two mandrels 100 are on the cross conveyor 132.

Another method of producing coreless product 104 using mandrels 100 in rewinder 10 mounts the mandrels 100 permanently in the rewinder 10 on a ring, track or turret type system. The coreless product 104 is stripped off the mandrels 100 and moved out through the frame 122 while the mandrels 100 remain inside the frames 122. Empty mandrels 100 return to the insert area by passing under the lower winding roll 20.

Mandrel rewinders and systems of handling mandrels are well known to one of ordinary skill in the art. The illustrated preferred embodiment for rewinding coreless product 104 is unique in that it uses mandrels 100 without cores or glue in a continuous winding system based on the three roll surface winding concept. One reason this rewinder 10 is better at winding coreless product than other winders is in the use of the winding control fingers 30 to control the mandrel insertion process. The two winding control fingers 30 and the upper and lower winding rolls 16, 20 trap the mandrel 100 on all sides. The bearing supports 114 on the winding control fingers 30 hold the mandrel 100 centered with a small gap between the winding control fingers 30 and the mandrel 100, and between the winding rolls 16, 20 and the mandrel 100. The contact between the friction drive area 118 on one end of the mandrel 100 and the lower winding roll 20 positively spins the mandrel 100 up to roll speed as the mandrel 100 reaches the nip 56. When the lead winding control finger 30 separates the web 12 just in front of the mandrel 100, the web 12 collects in the area over the mandrel 100 and contact is made between the spinning mandrel 100 and loose web 12. The web 12 follows the only path open to it and wraps the mandrel 100 to start the winding process. Other surface winder designs lack both the control and separation systems to effectively wind coreless product on mandrels reliably at very high speeds up to about 3,000 feet per minute.

EXAMPLE

The following is one illustrative example of rewinding bathroom tissue product on a core 28 using one preferred embodiment of the present invention:

PRODUCT SPECIFICATIONS: 280 sheet count, Roll L diameter 4.25", Core diameter 1.75"O.D., Sheet length 4.5", 105'/roll (log).

PRODUCTION SPEED: 3,000'/minute paper speed, 28.57 logs/minute.

EQUIPMENT GEOMETRY: 8" diameter upper winding roll 16. 4.5" diameter rider roll 26. 15" diameter lower winding roll 20. The nip 56 between the upper and lower winding rolls 16, 20 is adjustable from 1.375" to 2.25" by moving the lower winding roll 20. Other diameters of cores 28 can be used by moving both the lower winding roll 16 and the winding control fingers ring supports, and replacing the winding control fingers 30.

Figure 21:
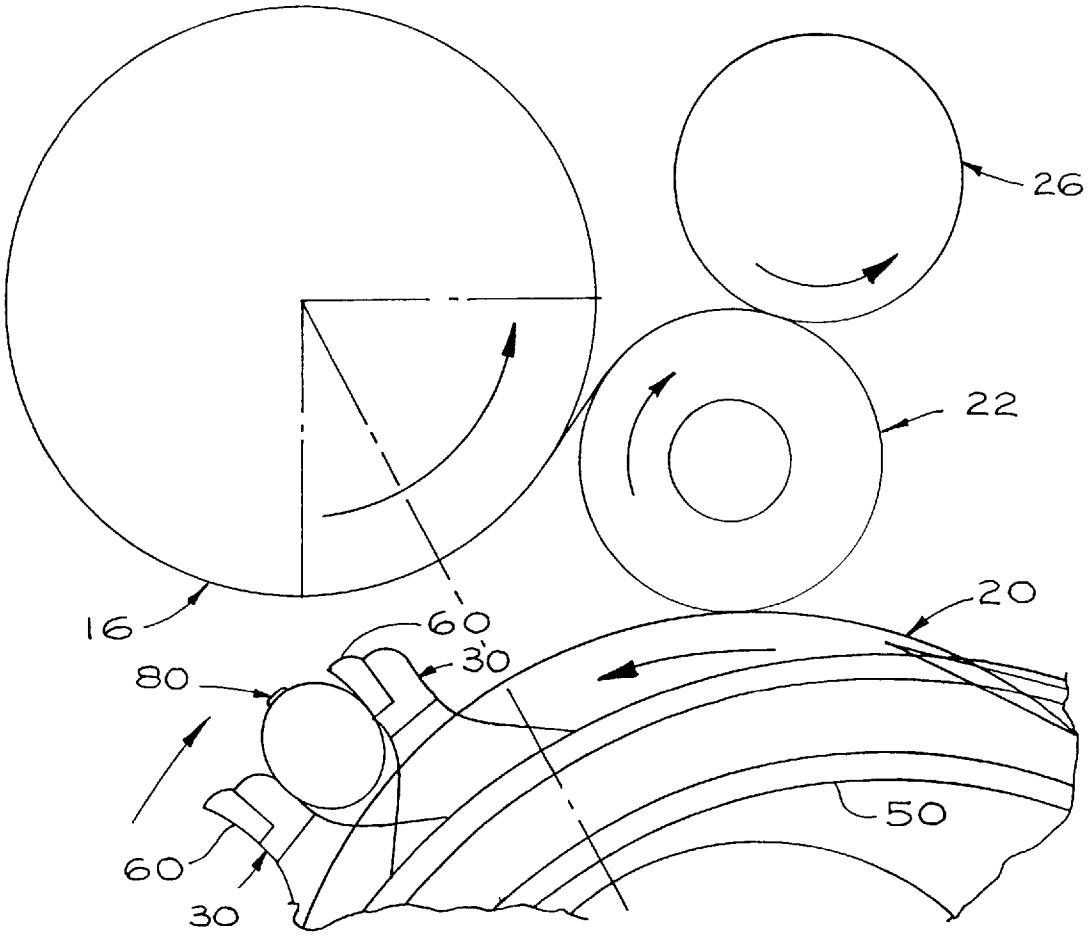
FIG. 21 illustrates an enlarged side view of the rewinder shown in FIGS. 1–10 squeezing and preparing a new core for rewinding and winding a log in accordance with the Example.

FIG. 21: The upper winding roll 16 has a constant surface speed of 3,000'/minute. The lower winding roll 20 has started a rapid deceleration from 3,000'/minute to 2,850'/minute. The core 28 is held between the two winding control fingers 30 by about 0.125" squeeze applied to the core 28 by the winding control fingers 30. The tips 60 of the winding control fingers 30 are moving toward the nip 56 between the winding rolls 16, 20 at 1,000'/minute. The tip 60 of the leading winding control finger 30 will interfere with the upper winding roll 16 by 0.031" over an arc of 1". The nip 56 between the upper and lower winding rolls 16, 20 is 0.062" smaller than the outside diameter of the core 28. The nearly completed log 22 will start to move away from the upper winding roll 16 as the lower winding roll 20 decelerates.

Figure 22:
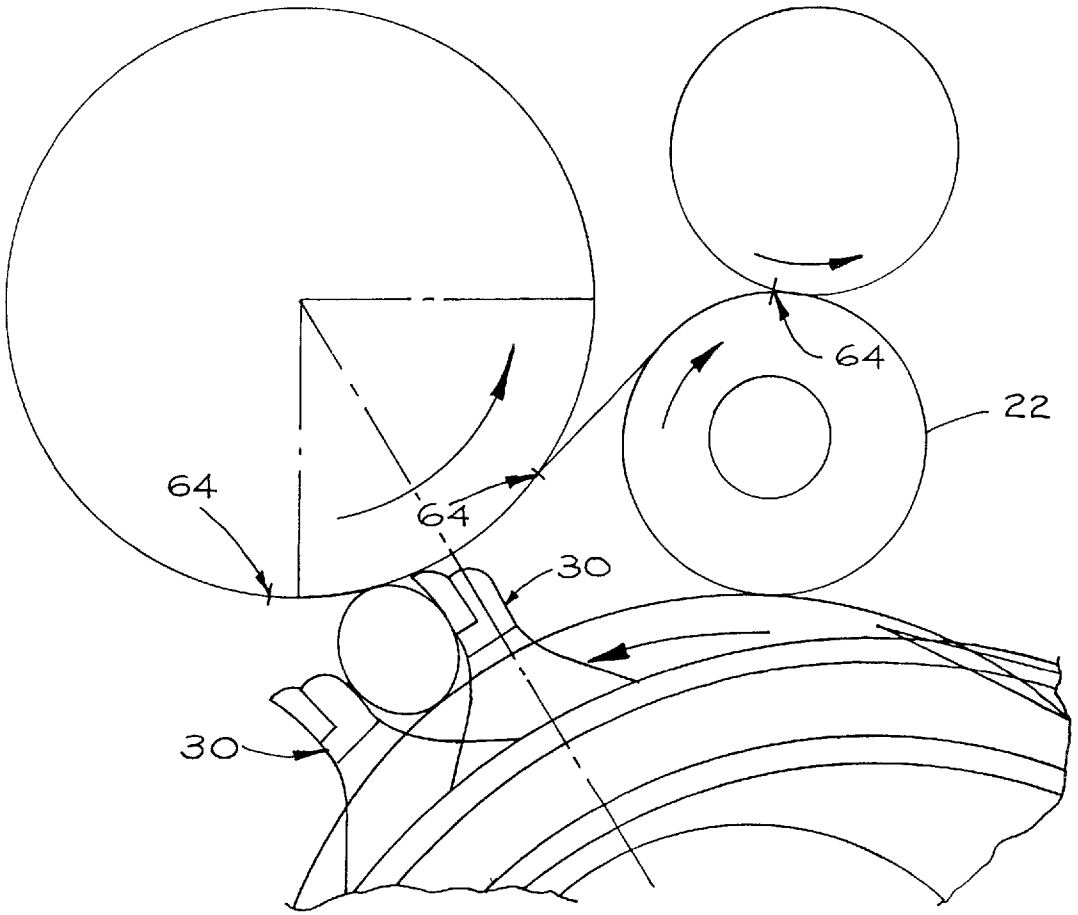
FIG. 22 shows an enlarged side view of the rewinder shown in FIG. 21 prior to web separation when a tip of a winding control has just contacted the upper winding roll and a glued area of the new core is beginning to contact the web.

FIG. 22: The tip 60 of the leading winding control finger 30 first contacts the web 12 on the upper winding roll 16 midway between two perforations. The point of contact is 0.5" before the center of the nip 56. The web 12 pinched between the tip 60 of the winding control finger 30 and the upper winding roll 16 will slow to the speed of the winding control finger 30. This slowing is primarily attributable to the higher coefficient of friction between the web 12 and the 75 durometer polyurethane tip 60 as compared to the web 12 and the 32 roughness average surface finish on the upper winding roll 16. The trailing winding control finger 30 rapidly decelerates to a stop as the core 28 is squeezed between the rolls 16, 20.

Figure 23:
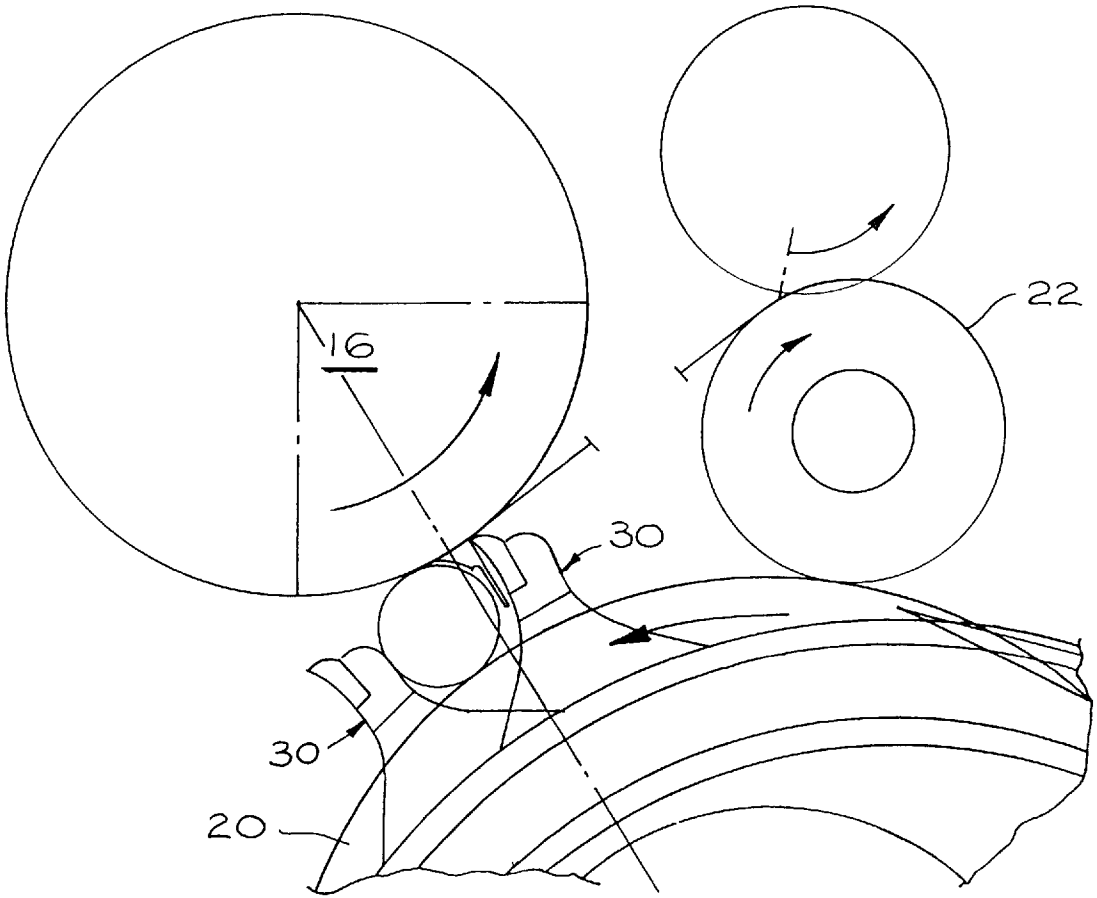
FIG. 23 shows an enlarged side view of the rewinder shown in FIG. 21 after web separation while the leading edge of the web is forming a loop between the core and the winding control finger.

FIG. 23: The tip 60 of the leading winding control finger 30 completes contact with the upper winding roll 16. The peripheral surface of the upper winding roll 16 has moved 3" as the web 12 at the tip of the winding control finger 30 has only moved 1", resulting in 2 inches of web slippage. This slippage tears the web 12 at the one perforation between the winding control finger 30 and the completed log 22. The core 28 is squeezed between the two rolls 16, 20 and is accelerated to 6500 rpm by contact with the rolls 16, 20 along the full length of the core 28. The core 28 will drive the web 12 ahead of it due to the squeeze between the core 28 and the upper winding roll 16. The extra 2" of web 12 will form a loop between the core 28 and the leading winding control finger 30. The combination of the shape of the winding control finger 30, the rotation of the core 28, and the glue attaching the web 12 to the core 28 will cause the web 12 to follow the core 28 down toward the nip between the core 28 and the lower winding roll 20. The core 28 and the completed roll will move ahead at a rate of 15"/second due to the 30"/second (150'/minute) difference in surface speed between the upper and lower winding roll 16, 20.

Figure 24:
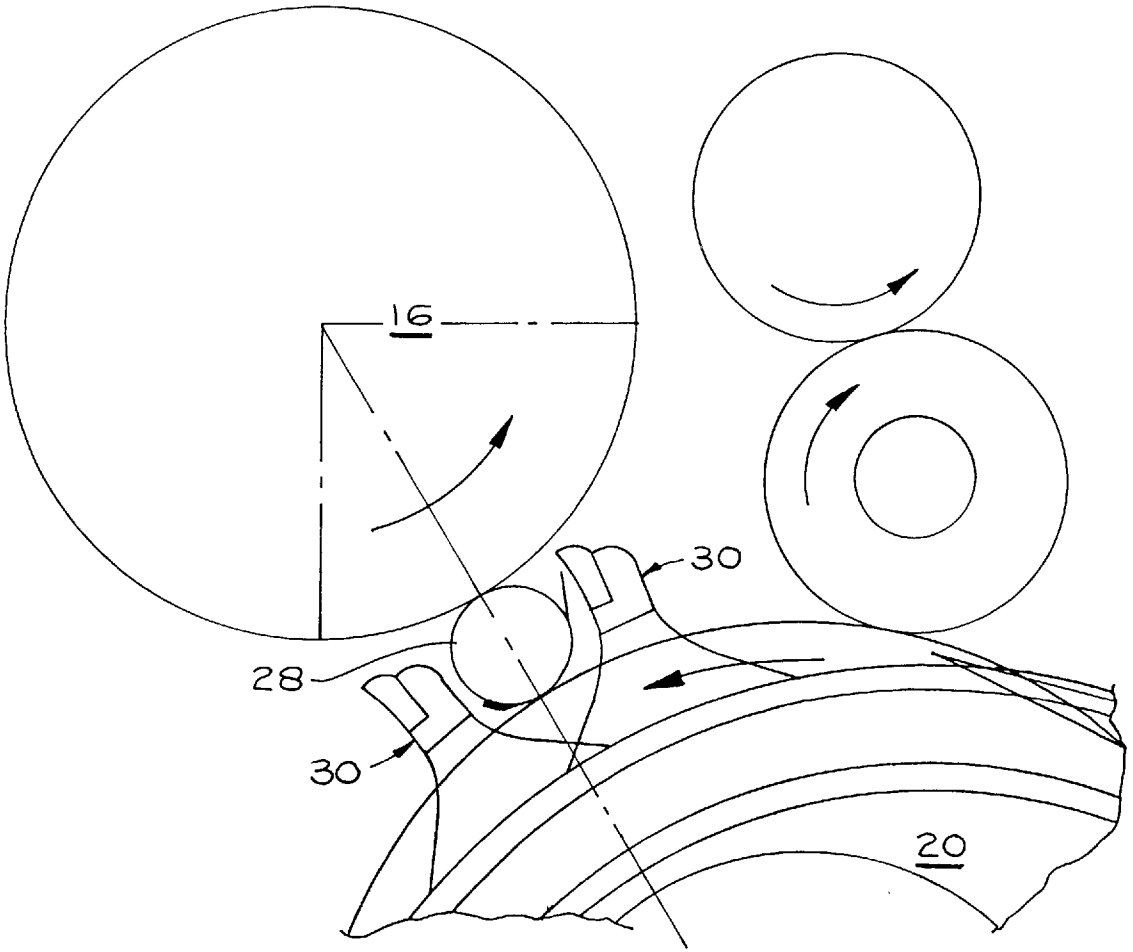
FIG. 24 shows an enlarged side view of the rewinder shown in FIG. 21 after a new log has started rewinding and a wound log is being removed from the rewinding station by a winding control finger.

FIG. 24 The web 12 which was pinched between the lead winding control finger 30 and the upper winding roll 16 is now free to wrap the core 28 because contact is lost between the winding control finger 30 and the roll 16. The combination of the lead winding control finger 30, the core 28 motion and the lower winding roll 20 motion will cause the web 12 to be drawn through the nip 56 between the lower winding roll 20 and the core 28. If the web 12 is not well attached to the core 28 at this point, the trailing winding control finger 30 will help direct the web 12 up toward the nip between the core 28 and the upper winding roll 16 to complete the first wrap of the web 12 on the core 28.

Figure 25:
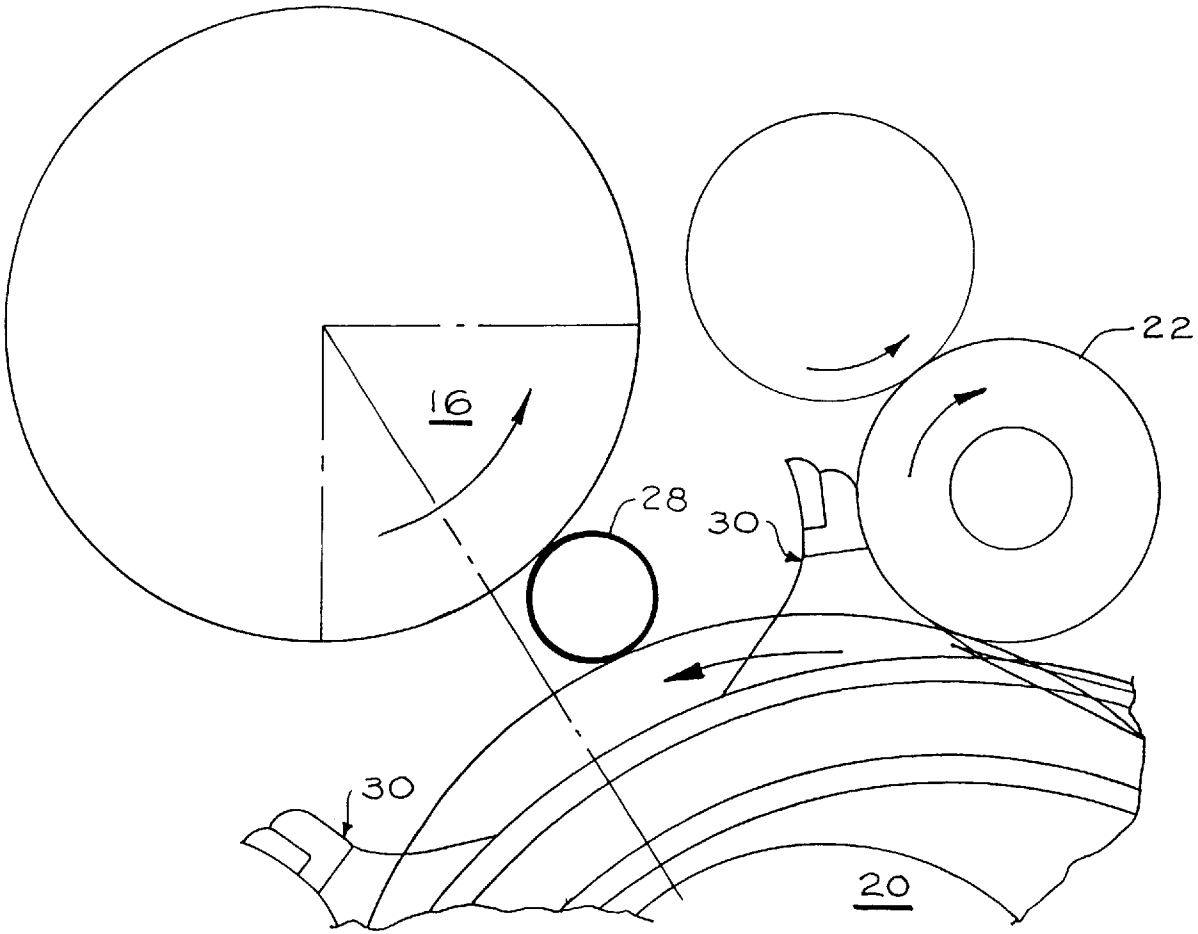
FIG. 25 illustrates an enlarged side view of the rewinder shown in FIG. 21 rewinding the new log and moving the wound log under a deceleration hood with a winding control finger.

FIG. 25: The lead finger decelerates to 15"/second to help push the completed log 22 out of the cradle 24. The trailing winding control finger 30 stops before the tip 60 contacts the upper winding roll 16. This winding control finger 30 then reverses direction and returns for the next core 28.

Figure 26:
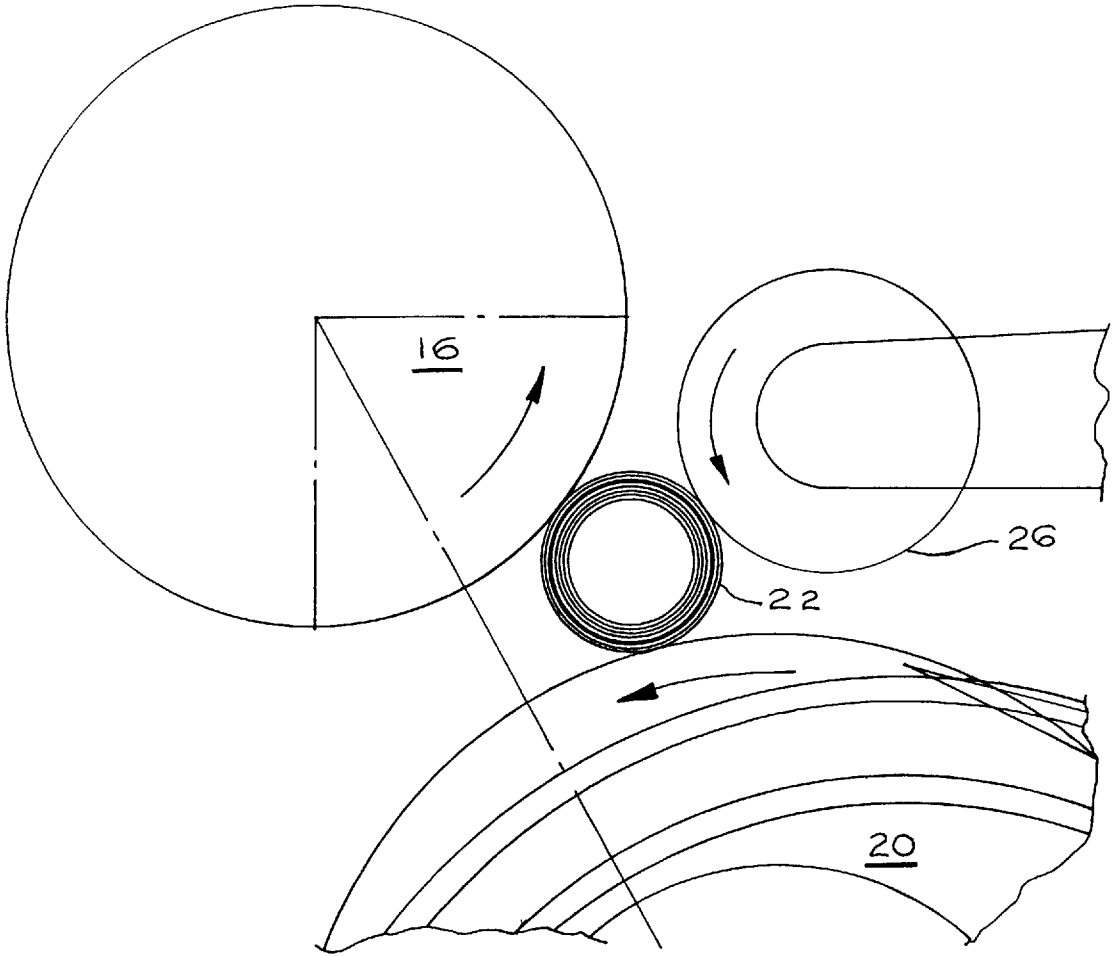
FIG. 26 shows an enlarged side view of the rewinder shown in FIG. 21 after a new log has started rewinding in a step of the process just prior to the step shown in FIG. 21.

FIG. 26: The rider roll 26 is now in contact with the building log 22. The lower winding roll 20 is in the process of accelerating back to the surface speed of the upper winding roll 16.

While preferred embodiments have been illustrated and described, it should be understood that changes and modifications can be made thereto without departing from the invention in its broader aspects. Various features of the invention are defined in the following claims.

We claim:

1. A rewinder for rewinding a web of material comprising:

an upper winding roll, a lower winding roll and a rider roll mounted adjacent one another;

at least one winding control finger mounted for rotation with respect to said upper winding roll for inserting a core for rewinding adjacent at least two of said rolls; and wherein at least one of said winding control fingers is selectively engageable with said upper winding roll to separate the web.

2. The rewinder defined in claim 1, wherein two of said winding control fingers insert a core for rewinding adjacent at least two of said rolls.

3. The rewinder defined in claim 1, wherein at least one of said winding control fingers is driven independently of another of said winding control fingers.

4. The rewinder defined in claim 1, wherein a winding control finger removes the core from its position adjacent at least two of said rolls after rewinding.

5. The rewinder defined in claim 1, wherein said selective engagement between at least one of said winding control fingers and said upper winding roll is radially adjustable.

6. The rewinder defined in claim 1, wherein at least one of said winding control fingers includes a tip comprising an elastic material.

7. The rewinder defined in claim 6, wherein said tip is selectively engageable with said upper winding roll to separate the web.

8. A rewinder for rewinding a web of material, comprising:

at least two winding rolls mounted for rotation adjacent one another;

a web supplied adjacent at least one of said winding rolls; and at least one pair of winding control fingers mounted for rotation with respect to at least one of said winding rolls, wherein at least one of said winding control fingers places a core adjacent said winding rolls for rewinding, and at least one of said winding control fingers is selectively engageable with said upper winding roll to separate the web after rewinding a portion of the web on the core.

9. The rewinder defined in claim 8, wherein two of said winding control fingers insert the core for rewinding adjacent at least two of said rolls.

10. The rewinder defined in claim 9, wherein said two winding control fingers squeeze the core.

11. The rewinder defined in claim 8, wherein at least one of said winding control fingers is driven independently of another of said winding control fingers.

12. The rewinder defined in claim 8, wherein a winding control finger removes the core from its position adjacent at least two of said rolls after rewinding.

13. The rewinder defined in claim 8, wherein said selective engagement between at least one of said winding control fingers and said upper winding roll is radially adjustable.

14. The rewinder defined in claim 8, wherein at least one of said winding control fingers comprises a tip including an elastic material.

15. The rewinder defined in claim 14, wherein said tip is selectively engageable with said upper winding roll to separate the web.

16. A method of rewinding material from a large roll to a series of smaller rolls, comprising:

feeding a web of the material to a first roll located adjacent second and third rolls;

inserting a core adjacent said rolls with at least one winding control finger and bringing the core up to about a rotational speed of at least one of said rolls;

winding the web onto the core; and separating the web with at least one of said winding control fingers contacting one of said rolls.

17. The method as defined in claim 16, wherein two of said winding control fingers insert the core for rewinding adjacent at least two of said rolls.

18. The method as defined in claim 16, wherein at least one of said winding control fingers is driven independently of another of said winding control fingers.

19. The method as defined in claim 16, further comprising the step of removing the core from its position adjacent at least two of said rolls after winding with a winding control finger.

20. The method as defined in claim 16, further including the step of adjusting at least one of said winding control fingers to compensate for wear.

* * * * *